US011752792B2

(12) United States Patent
Donner et al.

(10) Patent No.: US 11,752,792 B2
(45) Date of Patent: Sep. 12, 2023

(54) METHOD AND APPARATUS FOR APPLYING A MATERIAL ONTO ARTICLES USING A TRANSFER COMPONENT

(71) Applicant: The Procter & Gamble Company, Cincinnati, OH (US)

(72) Inventors: Christopher Gerald Donner, Playa del Carmen Q Roo (MX); Robert Paul Cassoni, Waynesville, OH (US); Matthew Richard Allen, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 78 days.

(21) Appl. No.: 17/191,746

(22) Filed: Mar. 4, 2021

(65) Prior Publication Data

US 2021/0276355 A1 Sep. 9, 2021

Related U.S. Application Data

(60) Provisional application No. 62/986,828, filed on Mar. 9, 2020.

(51) Int. Cl.
*B41M 5/025* (2006.01)
*B41J 2/005* (2006.01)
(Continued)

(52) U.S. Cl.
CPC ..... *B41M 5/0256* (2013.01); *B41J 2/0057* (2013.01); *B44C 1/1733* (2013.01);
(Continued)

(58) Field of Classification Search
CPC ..... B41F 16/00; B41J 2/0057; B41J 3/40731; B41J 3/40733; B41M 5/0256; B44C 1/17; B44C 1/1733
See application file for complete search history.

(56) References Cited

U.S. PATENT DOCUMENTS 2,134,041 A 10/1938 Hamm
2,461,281 A 2/1949 Jackson
(Continued)

FOREIGN PATENT DOCUMENTS

CN 1271319 A 10/2000
CN 2818150 Y 9/2006
(Continued)

OTHER PUBLICATIONS

US 9,193,175 B2, 11/2015, Kraus (withdrawn)
(Continued)

*Primary Examiner* — Sonya M Sengupta

(74) *Attorney, Agent, or Firm* — William E. Gallagher; Sarah M. Decristofaro

(57) ABSTRACT

Apparatuses and methods for applying a transfer material onto one or more surfaces of an article are disclosed, including apparatuses and methods of transfer printing on and/or decorating three-dimensional articles, as well as the articles printed and/or decorated thereby. The apparatuses and methods may include providing a deposition device, such as a printing device; providing a transfer component; depositing a material onto a portion of the transfer component with the deposition device; modifying the portion of the transfer component with the transfer material thereon to conform the transfer component to at least a portion of one or more surfaces of the three-dimensional article; and transferring the transfer material onto the one or more surfaces of the article.

11 Claims, 21 Drawing Sheets

(51) Int. Cl.
*B44C 1/17* (2006.01)
*B41J 3/407* (2006.01)
*B41F 16/00* (2006.01)

(52) U.S. Cl.
CPC ..... *B41F 16/00* (2013.01); *B41J 3/40731* (2020.08); *B41J 3/40733* (2020.08); *B44C 1/17* (2013.01)

(56) References Cited

U.S. PATENT DOCUMENTS 3,124,065 A 3/1964 Bozek et al.
3,276,356 A 10/1966 Usko et al.
3,313,667 A 4/1967 Flood
3,418,926 A 12/1968 Ichiro
3,434,902 A 3/1969 Bliss
3,483,063 A 12/1969 Baines
3,587,455 A 6/1971 Childress et al.
3,653,176 A 4/1972 Gess
4,129,473 A 12/1978 Perret
4,180,105 A 12/1979 Harvey
4,201,621 A 5/1980 Crankshaw
4,214,937 A 7/1980 Geurtsen
4,315,795 A 2/1982 Jodrey
4,342,399 A 8/1982 Stirling
4,349,402 A 9/1982 Parker
4,405,403 A 9/1983 Jodrey
4,583,460 A 4/1986 Maslin
4,594,123 A * 6/1986 Eder ..... B65C 9/06 156/578
4,769,100 A 9/1988 Short et al.
4,828,637 A 5/1989 Mentzer et al.
4,838,973 A 6/1989 Mentzer et al.
4,960,482 A 10/1990 Crane et al.
5,104,719 A 4/1992 Kamen et al.
5,116,452 A 5/1992 Eder
5,259,912 A 11/1993 Cline
5,385,252 A 1/1995 Hidding
5,388,695 A 2/1995 Gilbert
5,413,651 A 5/1995 Otruba
5,565,055 A 10/1996 Croci
5,674,345 A 10/1997 Nash
5,832,819 A 11/1998 Widman
6,070,524 A 6/2000 Marroquin-garza
6,110,316 A 8/2000 Kobayashi et al.
6,119,751 A 9/2000 Nilsen et al.
6,135,654 A 10/2000 Jennel
6,143,407 A 11/2000 Lythgoe et al.
6,164,199 A 12/2000 Dubuit
6,250,316 B1 6/2001 Brandt et al.
6,491,782 B1 12/2002 Jaynes
6,565,968 B1 5/2003 Li
6,578,476 B2 6/2003 Liguori et al.
6,584,894 B1 7/2003 Mason
6,699,352 B2 3/2004 Sawatsky
6,736,055 B2 5/2004 Lutz et al.
6,835,268 B2 12/2004 Widman
6,920,822 B2 7/2005 Finan
6,957,030 B2 10/2005 Baker, Jr. et al.
7,011,728 B2 3/2006 Dewig et al.
7,014,895 B1 3/2006 Grotefend
7,048,651 B2 5/2006 Kennedy, III et al.
7,210,408 B2 5/2007 Uptergrove
7,220,333 B1 5/2007 Bethune
7,261,033 B2 8/2007 Dubuit
7,290,803 B2 11/2007 Scarbrough et al.
7,373,878 B2 5/2008 Finan
7,448,323 B2 11/2008 Kennedy, III et al.
7,467,847 B2 12/2008 Baxter et al.
7,556,708 B2 7/2009 Phillips
7,625,059 B2 12/2009 Uptergrove
7,704,345 B2 4/2010 Bosshardt
7,736,713 B2 6/2010 Uptergrove
7,765,931 B2 8/2010 Kennedy, III et al.
7,815,761 B2 10/2010 Phillips
7,874,339 B2 1/2011 France
7,887,176 B2 2/2011 Kovacs et al.
7,891,799 B2 2/2011 Edwards
8,192,010 B2 6/2012 Edwards
D663,622 S 7/2012 Diss
8,233,829 B2 7/2012 Miyazaki
8,317,311 B2 11/2012 Edwards
8,323,438 B2 12/2012 Roof et al.
8,430,498 B2 4/2013 Edwards
8,477,163 B2 7/2013 Hirst
8,522,989 B2 9/2013 Uptergrove
8,551,270 B2 10/2013 Previty et al.
8,579,402 B2 11/2013 Uptergrove
8,616,259 B1 12/2013 Woods et al.
8,628,187 B2 1/2014 Roof et al.
8,667,895 B2 3/2014 Gerigk et al.
8,714,731 B2 5/2014 Leung et al.
8,740,367 B2 6/2014 Edwards
8,814,346 B2 8/2014 Edwards
8,851,136 B1 10/2014 Drynkin et al.
8,876,979 B2 11/2014 Uptergrove et al.
8,889,232 B2 11/2014 Cong
8,899,739 B2 12/2014 Ohnishi
8,919,247 B2 12/2014 Morgavi et al.
8,943,968 B2 2/2015 Tanaka et al.
8,993,219 B2 3/2015 Richert et al.
9,032,872 B2 5/2015 Uptergrove
9,079,351 B2 7/2015 Turner et al.
9,090,090 B2 7/2015 Putzer et al.
9,132,664 B2 9/2015 Schach
9,144,957 B2 9/2015 Lee
9,150,325 B2 10/2015 Uptergrove et al.
9,156,134 B2 10/2015 Kim
9,211,966 B2 12/2015 Broad
9,221,573 B2 12/2015 Lorence et al.
9,221,621 B2 * 12/2015 Papsdorf ..... B65G 47/848
9,227,794 B2 * 1/2016 Papsdorf ..... B65G 37/00
9,254,687 B2 2/2016 Ohnishi
9,272,534 B2 3/2016 Domeier et al.
9,284,686 B1 * 3/2016 Lindsey ..... D21G 9/0054
9,290,016 B2 3/2016 Landa et al.
9,303,185 B2 4/2016 Sambhy et al.
9,403,357 B1 8/2016 Robinson et al.
9,475,327 B2 10/2016 Izawa
9,487,027 B1 11/2016 Strater, Jr. et al.
9,517,618 B2 12/2016 Landa et al.
9,708,509 B2 7/2017 Zajaczkowski
10,035,338 B2 7/2018 Howard
10,144,225 B2 12/2018 Koers
10,214,655 B2 2/2019 Liu
2001/0030021 A1 10/2001 Romig
2002/0168212 A1 11/2002 Nedblake, Jr. et al.
2003/0102078 A1 6/2003 Dabrowski
2005/0098269 A1 5/2005 Ballarotti
2005/0167035 A1 8/2005 Laskey et al.
2005/0274687 A1 12/2005 McCutchan
2006/0018698 A1 1/2006 Vogt
2006/0194024 A1 8/2006 Nakayama
2006/0254445 A1 11/2006 Masuda
2007/0019049 A1 1/2007 Heiman et al.
2007/0098933 A1 5/2007 Opuszko et al.
2007/0157576 A1 7/2007 Till
2007/0254121 A1 11/2007 Cerveny
2008/0043087 A1 2/2008 Cowan
2008/0197540 A1 8/2008 McAllister et al.
2008/0216692 A1 9/2008 Zaher
2009/0000733 A1 1/2009 Berndtsson
2009/0056858 A1 3/2009 Davila Casitas et al.
2009/0207198 A1 8/2009 Muraoka
2010/0038022 A1 2/2010 Lapelosa
2010/0039487 A1 2/2010 Sawatsky
2010/0091057 A1 4/2010 Kennedy, III et al.
2010/0096386 A1 4/2010 Uptergrove et al.
2010/0212821 A1 8/2010 Grinberg et al.
2010/0257819 A1 10/2010 Schach
2010/0307692 A1 * 12/2010 Lorence ..... B32B 27/18 156/578
2011/0067584 A1 3/2011 Mueller et al.
2011/0223362 A1 9/2011 Van

(56) References Cited

U.S. PATENT DOCUMENTS

| | | | | |
|---|---|---|---|---|
| 2011/0232514 | A1 | 9/2011 | Putzer et al. | |
| 2011/0250412 | A1 | 10/2011 | Johnson et al. | |
| 2012/0031548 | A1 | 2/2012 | Broad | |
| 2012/0061014 | A1 | 3/2012 | Patel et al. | |
| 2012/0210894 | A1 | 8/2012 | Nagase | |
| 2013/0019566 | A1 | 1/2013 | Schach | |
| 2013/0075040 | A1 | 3/2013 | Grinberg et al. | |
| 2013/0193022 | A1 | 8/2013 | Uptergrove | |
| 2013/0206328 | A1 | 8/2013 | Chiu et al. | |
| 2013/0242016 | A1 | 9/2013 | Tennis | |
| 2013/0314470 | A1 | 11/2013 | Igawa | |
| 2014/0109828 | A1 | 4/2014 | Grinberg | |
| 2014/0285600 | A1 | 9/2014 | Domeier et al. | |
| 2014/0302289 | A1 | 10/2014 | Duzy et al. | |
| 2014/0338840 | A1 | 11/2014 | Lux et al. | |
| 2015/0020949 | A1 | 1/2015 | Howard | |
| 2015/0022602 | A1 | 1/2015 | Landa et al. | |
| 2015/0024648 | A1 | 1/2015 | Landa et al. | |
| 2015/0144517 | A1 | 5/2015 | Allen | |
| 2015/0183544 | A1 | 7/2015 | Moffatt et al. | |
| 2015/0189953 | A1 | 7/2015 | Langvin | |
| 2015/0217550 | A1 | 8/2015 | Gosnell et al. | |
| 2015/0314580 | A1 | 11/2015 | Sato et al. | |
| 2015/0343761 | A1 | 12/2015 | Roeder et al. | |
| 2015/0343762 | A1 | 12/2015 | Shaul et al. | |
| 2016/0129680 | A1 | 5/2016 | Ikeda et al. | |
| 2016/0222228 | A1 | 8/2016 | Uptergrove et al. | |
| 2017/0182513 | A1* | 6/2017 | Cassoni | B41M 5/0256 |
| 2017/0182704 | A1* | 6/2017 | Allen | B41J 3/40733 |
| 2017/0182705 | A1* | 6/2017 | Allen | B65C 3/065 |
| 2017/0182756 | A1 | 6/2017 | Cassoni et al. | |
| 2017/0183124 | A1* | 6/2017 | Allen | B65C 9/1873 |
| 2017/0203557 | A1 | 7/2017 | Cho et al. | |
| 2018/0272682 | A1 | 9/2018 | Allen | |
| 2018/0354249 | A1* | 12/2018 | Martinez de Leon | C09J 4/00 |
| 2019/0153248 | A1* | 5/2019 | Martinez de Leon | C09D 11/322 |
| 2019/0337304 | A1 | 11/2019 | Allen | |
| 2020/0047419 | A1 | 2/2020 | Allen | |
| 2020/0254751 | A1 | 8/2020 | Cassoni | |
| 2020/0254752 | A1 | 8/2020 | Bourgeois | |
| 2020/0254792 | A1 | 8/2020 | Cassoni | |
| 2020/0254802 | A1 | 8/2020 | Cassoni | |
| 2020/0254803 | A1 | 8/2020 | Cassoni | |
| 2021/0276355 | A1* | 9/2021 | Donner | B41M 5/0256 |

FOREIGN PATENT DOCUMENTS

| | | | | |
|---|---|---|---|---|
| CN | 201234412 | Y | 5/2009 | |
| CN | 101554933 | A | 10/2009 | |
| CN | 101574875 | A | 11/2009 | |
| CN | 201475524 | U | 5/2010 | |
| CN | 101734033 | A | 6/2010 | |
| CN | 102423962 | A | 4/2012 | |
| CN | 202319287 | U | 7/2012 | |
| CN | 203818720 | U | 9/2014 | |
| CN | 105691018 | A | 6/2016 | |
| CN | 106113959 | A | 11/2016 | |
| CN | 108472972 | A | 8/2018 | |
| DE | 10337402 | | 3/2005 | |
| DE | 102015104321 | | 9/2016 | |
| EP | 0076593 | | 4/1983 | |
| EP | 0974524 | A1 | 1/2000 | |
| EP | 1163156 | B1 | 11/2003 | |
| EP | 2329954 | | 11/2010 | |
| EP | 3006220 | A1 | 4/2016 | |
| GB | 827313 | | 3/1960 | |
| GB | 898153 | | 6/1962 | |
| GB | 2236508 | A | 4/1991 | |
| GB | 2259888 | A | 3/1993 | |
| GB | 2368313 | B | 3/2004 | |
| JP | 2007283716 | | 11/2007 | |
| JP | 2013216013 | | 10/2013 | |
| JP | 2014223750 | A | 12/2014 | |
| JP | 6510102 | B1 | 4/2019 | |
| WO | 200020219 | A1 | 4/2000 | |
| WO | 200112440 | A1 | 2/2001 | |
| WO | 2006005607 | A1 | 1/2006 | |
| WO | 2008026926 | A1 | 3/2008 | |
| WO | 2009031854 | A2 | 3/2009 | |
| WO | 2015105635 | A1 | 7/2015 | |
| WO | 2015143296 | A1 | 9/2015 | |
| WO | 2016075446 | A1 | 5/2016 | |
| WO | WO-2021183350 | A1 * | 9/2021 | B41J 2/0057 |

OTHER PUBLICATIONS

All Office Actions, U.S. Appl. No. 16/787,061.
All Office Actions, U.S. Appl. No. 16/787,062.
All Office Actions, U.S. Appl. No. 16/787,064.
All Office Actions, U.S. Appl. No. 16/787,065.
All Office Actions, U.S. Appl. No. 16/787,069.
Xeikon "Labels & Packaging Heat Transfer Label Suite", brochure dated 2012, published by Xeikon International BV, Netherlands.
PCT Search Report and Written Opinion for PCTUS2021/020768 dated Jun. 23, 2021.

* cited by examiner

METHOD AND APPARATUS FOR APPLYING A MATERIAL ONTO ARTICLES USING A TRANSFER COMPONENT

FIELD

The present invention is directed to apparatuses and methods for applying a transfer material onto an article, including apparatuses and methods of transfer printing onto and/or decorating three-dimensional articles, as well as the articles having the transfer material thereon and/or which are decorated thereby.

BACKGROUND

Various apparatuses and methods of printing are disclosed in the patent literature and on the internet. Patent publications disclosing apparatuses and methods of printing include: U.S. Pat. No. 6,135,654, Jennel; U.S. Pat. No. 6,699,352 B2, Sawatsky; U.S. Pat. No. 6,920,822 B2, Finan; U.S. Pat. No. 7,210,408 B2, Uptergrove; U.S. Pat. No. 7,373,878 B2, Finan; U.S. Pat. No. 7,467,847 B2, Baxter, et al.; U.S. Pat. No. 8,522,989 B2, Uptergrove; U.S. Pat. No. 8,579,402 B2, Uptergrove; U.S. Pat. No. 8,667,895 B2, Gerigk, et al.; U.S. Pat. No. 8,714,731 B2, Leung, et al.; U.S. Pat. No. 8,899,739 B2, Ohnishi; U.S. Pat. No. 8,919,247 B2; Mogavi, et al.; U.S. Pat. No. 9,303,185 B2, Sambhy, et al.; and US Patent Application Publication Nos. US 2009/0207198 A1, Muraoka; US 2011/0232514 A1, Putzer, et al.; US 2013/0019566 A1, Schach; US 2014/0285600 A1, Domeier, et al.; US 2015/0022602 A1, Landa, et al.; US 2015/0024648 A1, Landa, et al.; and EP 1163156 B1, Johnson. Other types of apparatuses and methods include the apparatus and method disclosed in U.S. Patent Application Pub No. US 2012/0031548 A1, "Apparatus and Method for Applying a Label to a Non-Ruled Surface", filed in the name of Broad.

A number of current efforts are being directed to printing, particularly inkjet printing, on three-dimensional articles such as bottles and the like. Some current printing apparatuses and processes use ink jet printing to print directly on three-dimensional articles. Unfortunately, with current inkjet technology and current printing apparatuses, the quality of labels that may be formed by printing directly on three-dimensional articles is not as good as that formed on separately printed flat labels. Further, such printing processes may only be able to accurately jet ink short distances (e.g., several millimeters) from the print head. Therefore, if the article has surface features that differ in height or depth by more than such short distances, the ink jetted by an ink jet print head will not be accurately applied, leading to defects in print quality.

Other processes for applying ink to three-dimensional articles are transfer processes. In these processes, ink is first applied to a transfer surface, and then the image is transferred from the transfer surface to the article. Current transfer processes suffer from the disadvantage that they are not well suited to transfer the image from the transfer surface to articles with complex three-dimensional shapes and/or which have surface features that differ in height (or depth) by more than a limited extent.

It would be desirable to have improved apparatuses and methods for applying a transfer material or other materials onto three-dimensional articles.

SUMMARY

The present disclosure is directed to apparatuses and methods for applying a transfer material onto the surface of an article, including apparatuses and methods, also referred to herein as processes, of transfer printing onto and/or decorating three-dimensional articles, as well as the articles having the transfer material thereon and/or which are decorated thereby.

A method for transferring a transfer material from a transfer component to an article may include the following: providing a cavity comprising a frame that defines an opening, wherein the frame has a longitudinal frame axis and a transverse frame axis, and wherein the longitudinal frame axis is perpendicular to the transverse frame axis; providing an article comprising a face, wherein the face comprises a first edge portion and a second edge portion; providing a transfer component; transferring the article into the cavity; sealing a supported portion of the transfer component to the frame, wherein an unsupported portion of the transfer component is disposed over the opening, and wherein the unsupported portion of the transfer component comprises a transfer material, wherein the transfer material is in facing relationship with the face of the article, and wherein the face includes a predetermined contact area having a contact area first radius of curvature; modifying the unsupported portion of the transfer component to form a transfer component first radius of curvature extending in a direction parallel to the longitudinal axis and a transfer component second radius of curvature extending in a direction parallel to the transverse axis, wherein the contact area first radius of curvature of the article is different than at least one of the transfer component first radius of curvature and the transfer component second radius of curvature; contacting at least a portion of the unsupported portion of the transfer component to the predetermined contact area of the face of the article to form an initial contact area between the face and the transfer component; and modifying the unsupported portion of the transfer component such that the unsupported portion of the transfer component continues to contact the face of the article by moving from the initial contact area towards at least one of the first edge portion of the face and the second edge portion of the face.

A method for transferring a transfer material from a transfer component to an article may include the following: providing a cavity comprising a frame that defines an opening, wherein the frame has a longitudinal axis and a transverse axis, and wherein the longitudinal axis is perpendicular to the transverse axis; providing an article comprising a face, wherein the face comprises a first face portion, a second face portion opposite the first face portion, and an intermediate portion between the first face portion and the second face portion; providing a transfer component; transferring the article into the cavity; positioning the transfer component over the frame, wherein the transfer component comprises a supported portion of the transfer component that is supported by the frame and an unsupported portion of the transfer component extending over the opening of the frame, wherein the unsupported portion of the transfer component comprises a transfer material, and wherein the face is in facing relationship with the unsupported portion of the transfer component; sealing the supported portion of the transfer component to a perimeter of the frame; modifying the unsupported portion of the transfer component; contacting a portion of the unsupported portion of the transfer component to at least a portion of the intermediate portion of the face of the article to form an initial contact area; sweeping the unsupported portion of the transfer component such that the transfer component continues to contact the face of the article by moving from the initial contact area towards the first edge portion of the face and from the initial contact area towards the second edge portion of the face; and transferring the first transfer material from the transfer component to the face of the article.

A method for transferring a transfer material from a transfer component to an article may include the following: providing a cavity comprising a frame that defines an opening and a chamber, wherein the frame has a longitudinal axis and a transverse axis, and wherein the longitudinal axis is parallel to the transverse axis; providing an article comprising a face, wherein the face comprises a first edge portion and a second edge portion; providing a transfer component, wherein the transfer component comprises a transfer material; transferring the article into the cavity; positioning the transfer component over the frame, wherein the face of the article is in facing relationship with the transfer material disposed on the transfer component; sealing a supported portion of the transfer component to a perimeter of the frame, wherein an unsupported portion of the transfer component is disposed over the opening; applying a first pressure differential to the unsupported portion of the transfer component, wherein the unsupported portion of the transfer component is moved toward the first article; contacting a portion of the unsupported portion of the transfer component to a portion the face of the article to form an initial contact area; applying a second pressure differential to the unsupported portion of the transfer component, wherein the unsupported portion of the transfer component continues to contact the face of the article in a direction beginning from the initial contact area toward the frame.

The articles having the transfer material thereon and/or which are decorated by the processes may comprise any suitable three-dimensional articles.

These and additional features will be more fully disclosed in the following detailed description in conjunction with the drawings.

Figure 1A:
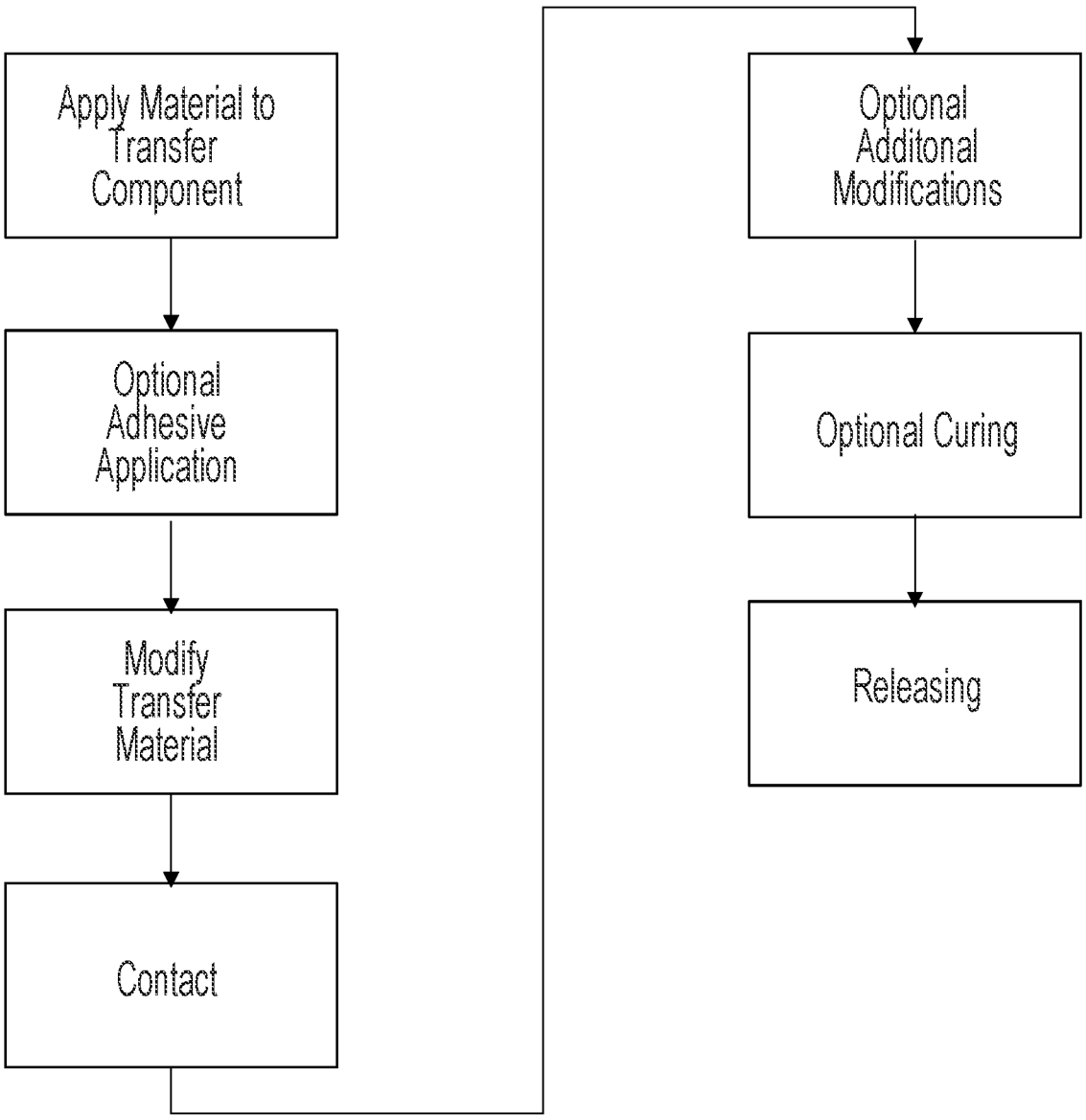
FIG. 1A is a flow chart illustrating a process for applying a transfer material onto an article.

The method, apparatus(es), and articles shown in the drawings are illustrative in nature and are not intended to be limiting. Moreover, the features will be more fully apparent and understood in view of the detailed description.

DETAILED DESCRIPTION

The present disclosure is directed to apparatuses and methods for applying a transfer material onto the surface of an article, including apparatuses and methods of transfer printing onto and/or decorating three-dimensional articles, as well as the articles having the transfer material thereon and/or are decorated thereby. The term "process" may be used herein interchangeably with the term "method".

FIG. 1A is a flow chart illustrating an example of a process for applying a transfer material onto the surface of a three-dimensional article. The process may include: (1) applying a transfer material to a transfer component (for example, by digitally printing a predetermined pattern including an image, text, words, symbols, or other aesthetics features onto the transfer component); (2) optionally applying an adhesive and/or varnish to the transfer component; (3) modifying a portion of the transfer component containing the transfer material as well as the transfer material (such as by stretching the same); (4) contacting the surface of the article with the transfer material using the transfer component (by moving at least one of the article or transfer component toward the other); (5) optionally performing an additional physical modification on the transfer component and transfer material thereon (such as by vacuum, air jets, fluid jets or combinations thereof) to bring the transfer component into closer contact with the surface of the article; (6) optionally curing the transfer material; and (7) transferring the transfer material from the transfer component to the article and releasing the transfer component from (indirect contact with) the surface of the article.

The term "transfer material", as used herein, will be used to describe the material that is transferred from the transfer component to the surface of the article. This term is inclusive of a material alone, or a combination of materials, any adhesive thereon, or other material(s) joined thereto that will be transferred to the surface of the article. The term "substance" may be used interchangeably with the term "material" herein with reference to the material(s) that are deposited on the transfer component and which will form all or part of the transfer material. Typically, one or more discrete or separate transfer materials will be transferred to each article 10.

Figure 1B:
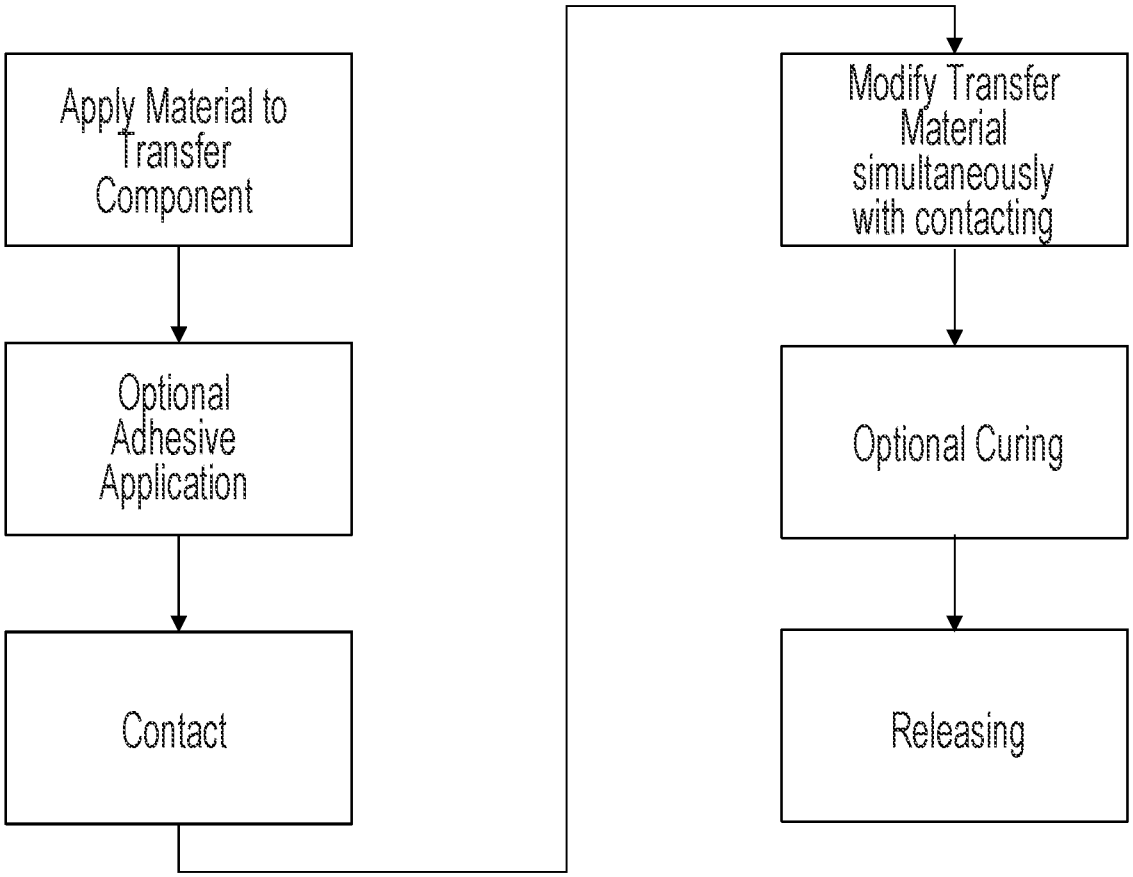
FIG. 1B is a flow chart illustrating a process for applying a transfer material onto an article.

FIG. 1B is a flow chart illustrating an example of a process for applying a transfer material onto the surface of a three-dimensional article. At least some portions of the modifying and contacting steps may occur simultaneously. More specifically, the three-dimensional article may be brought into contact with the transfer component, and the transfer component with the transfer material thereon may be modified simultaneously with the step of contacting. In such a case, for example, the transfer component may be a web which is held in tension, and the three-dimensional article may be forced into contact with the web to conform the web to the surface of the article. The term "conform", as used herein, does not require exact conformity, and includes partial conformity. There may, however, be aspects of the step of modifying the transfer component that are not necessarily simultaneous. For example, some aspects of modifying the portion of the transfer components with transfer material thereon may take place before contacting the article, and then additional modification of the transfer components with transfer material thereon may take place simultaneously with or after contacting the article. For instance, the initial modification of the transfer component with the transfer material may occur through simultaneous contact. This may be followed by a supplementary modification (e.g., positive pressure air or vacuum) that may be subsequent to the initial contact rather than simultaneous. Such a subsequent modification may be performed prior to any optional curing and releasing. The order of the modifying and contacting steps may be reversed. For example, the article may contact the transfer component, at least for a period of time, before any modification occurs. Thereafter, the article may be forced into contact with the transfer component, also referred to herein as a web, to conform the transfer component to the surface of the article.

Numerous variations of the order of steps of these processes, as well as mechanisms to carry out the processes, are possible. The order in which the steps take place may be varied, and/or the steps and/or portions of the different processes may be combined in any suitable manner. In addition, any other suitable steps may be added to any of these processes. Suitable additional steps may include, but are not limited to: applying machine direction and/or cross machine direction strain to the transfer component; applying a release coating to the transfer component prior to depositing a transfer material thereon; treating the surface of articles, or curing materials applied to the articles; additionally, embellishing the articles with additional materials (e.g., by the application of a metal material); transforming a property of an article (e.g., by laser); or combinations thereof. In addition, if a reusable transfer component is used, the processes may further include cleaning the transfer component after the releasing step. Such additional steps may be added, as appropriate, to either the front end and/or the back end of the processes of the categories shown in FIGS. 1A and 1B, and/or at any suitable place between any of the steps shown therein.

Figure 2:
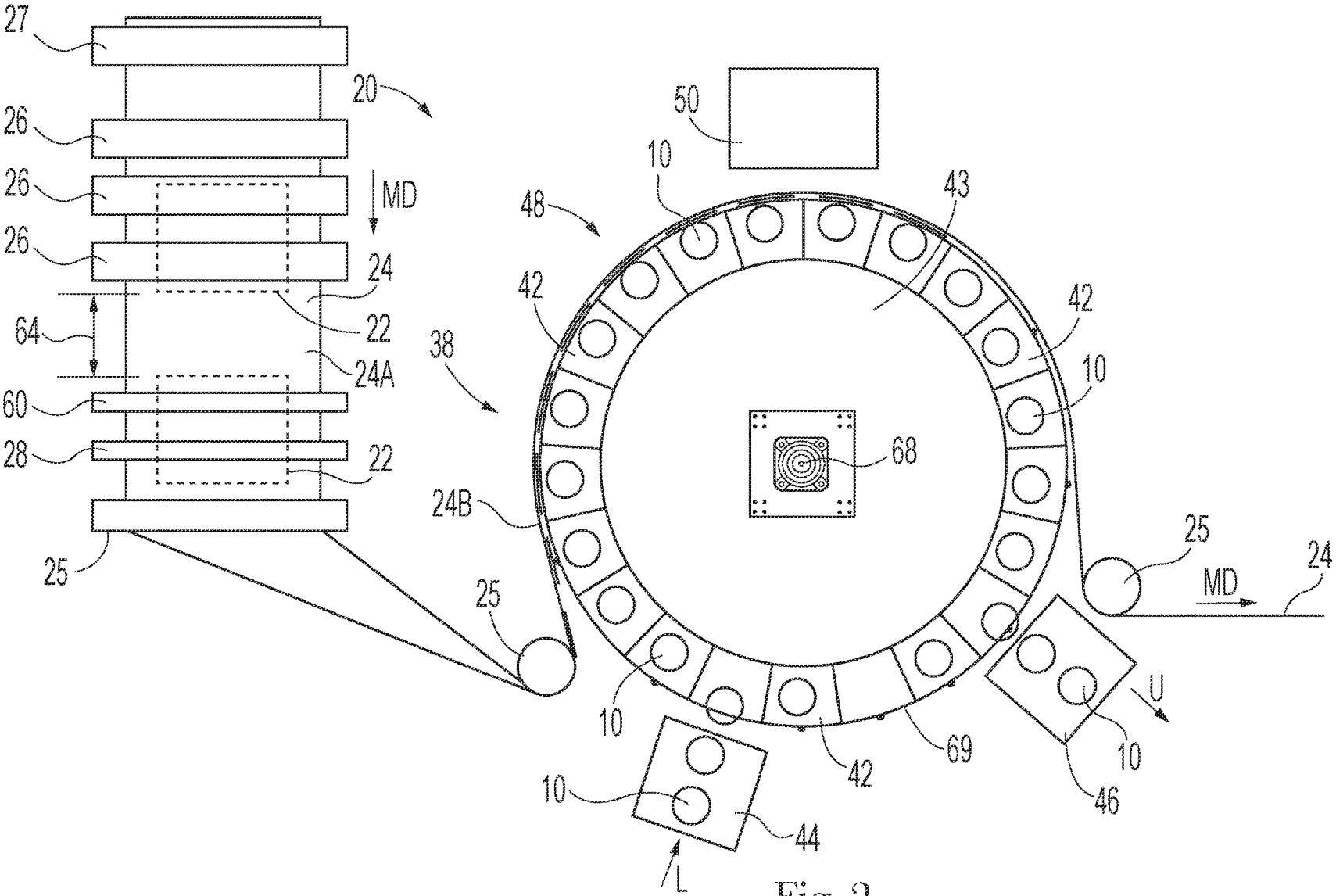
FIG. 2 is a schematic top view of an apparatus for applying a transfer material onto an article.

FIG. 2 illustrates an apparatus 20 for applying a transfer material 22 onto the surface of at least one article 10. The apparatus 20 may include a transfer component 24, an optional web control device 27, one or more deposition devices 26, an optional adhesive deposition device 28, an optional embellishment device 60, an array of cavities 38 including one or more cavities 42, an energy source 50, a loading station 44, and an unloading station 46. More specifically, the transfer component 24 may advance in a machine direction MD. The transfer component 24 may advance toward one or more deposition devices 26.

Prior to advancing the transfer component to the one or more deposition devices 26, the transfer component 24 may advance to a web control device 27. The transfer component 24 includes a cross machine direction width that is substantially perpendicular to the machine direction (MD). Based on the type of transfer material that will be applied by the one or more deposition devices, the strain in the cross machine direction width of the transfer component 24 may need to be controlled. For example, certain materials, such as inks, may cause wrinkles in the transfer component during the curing process, which occurs downstream of the material deposition process, if the strain in the web is not controlled during the material deposition process. The wrinkles in the transfer material may be visible to and unacceptable to consumers. Thus, to prevent or decrease the appearance of wrinkles in the transfer material on the article, the transfer component may be strained prior to receiving the transfer material. Strain may be introduced to the cross machine direction width of the transfer component by stretching the transfer component in the cross machine direction. One or more devices may be used to introduce this strain. The amount of strain is dependent, at least in part, on the types of transfer materials and the web handling of the transfer component. For example, the transfer component may be advanced over vacuum disks that hold the edges of the transfer component. The vacuum disks are angled such that the transfer component is initially held by a portion of the vacuum disks that are separated by a first, shorter distance and as the transfer component is rotated about the vacuum disks, the distance between the vacuum disks diverges to a second, longer distance. The transfer component is stretched in the cross machine direction width as the transfer component is rotated about the vacuum disks. A vacuum conveyor may be positioned downstream of the vacuum disks to maintain the cross machine direction strain in the transfer component during the transfer material deposition process. It is to be appreciated that other devices may be used to introduce strain into the transfer component prior to the transfer component receiving the transfer material. For example, two diverging vacuum conveyors may be used to strain the transfer component or a mechanical device that introduces strain, such as by gripping and pulling the transfer component. It is to be appreciated that one or more of these devices may be used in combination with one another.

The deposition devices may be configured to deposit one or more materials onto a surface 24A, 24B of the transfer component 24. The deposition devices 26 may be configured to deposit one or more materials onto a transfer surface 24A, which is opposite the back surface 24B, of the transfer component 24. The one or more materials deposited onto the transfer surface 24A is referred to herein as the transfer material 22. The transfer material 22 may be applied to the transfer component 24 in any form suitable for being transferred from the transfer component 24 to an article 10. The transfer material 22 may be applied to the transfer component 24 such that an undecorated portion 64 is present between each deposit of transfer material 22 onto the transfer component 24. The undecorated portion 64 may be determined, in part, based on the spacing of the articles 10, the properties of the transfer component 24, such as extensibility in the machine direction MD, and the design of the transfer material 22 that is to be applied to the article 10. The transfer component 24 with at least a portion of the transfer material 22 thereon may optionally traverse to an embellishment device 60 and an adhesive deposition device 28. The embellishment device may apply any suitable material to the transfer component or material thereon, including, for example, metallic material, and in any desired pattern, such as, for example, a printed electronic circuit. The embellishment device 60 may be used to add various effects to the transfer component 24, such as optical, tactile, and/or functional effects. The adhesive deposition device 28 may optionally deposit adhesive onto the transfer component 24. The adhesive may be needed to aid in transferring the transfer material 22 onto the transfer component 24. The materials applied by the material deposition device(s) 26, the embellishment device 60, and the adhesive deposition device 28 may together be referred to herein as the transfer material 22. It is to be appreciated that the embellishment device may be positioned prior to or after the deposition device, or one or more embellishment devices may be positioned prior to the deposition device and one or more embellishment devices may be positioned after the deposition device.

The transfer component 24 including the transfer material 22 may advance to a transfer device 48. The transfer component 24 may traverse about a portion of one or more idlers or rollers such that the one or more idlers do not adversely affect the transfer material 22 as the transfer component 24 advances to the transfer device 48. The idlers or rollers may be static, free-rotating, or driven, such as by a motor. The transfer device 48 may include an array of cavities 38. The array of cavities 38 may be in any configuration to accept one or more articles 10 and to aid in transferring the transfer material 22 from the transfer component 24. For example, the array of cavities 38 may be arranged in a linear configuration or a substantially circular configuration.

As illustrated in FIG. 2, the array of cavities 38 are arranged in a circular configuration about a drum 43. The drum 43 may include a drum axis 68 about which the drum 43 rotates and an outer circumferential surface 69 extending about the axis 68. Each cavity 42 of the array of cavities 38 may be positioned about the drum axis 68. More specifically, each cavity 42 of the array of cavities 38 may be joined to at least a portion of the drum 43. The array of cavities 38 may be positioned adjacent to the outer circumferential surface 69 of the drum 43. Any number of cavities 42 may be positioned about the axis 68. The number of cavities 42 may be an even number or an odd number. The number of cavities 42 may be based, in part, on the speed of the manufacturing line, the time to transfer the transfer material to the article, and the size of the article, for example.

The transfer device 48 may be positioned adjacent a loading station 44 and an unloading station 46. The loading station 44 may be configured to supply one or more articles to the transfer device 48. More specifically, one or more articles 10 may traverse, such as by a conveying device, to the loading station 44. The loading station 44 may accept the article 10 and, subsequently, load the article 10 into a cavity 42 of the array of cavities 38. As illustrated in FIG. 2, the articles traverse and are loaded into the cavity in a direction indicated by arrow L. The loading station 44 may be configured to load each cavity 42 as the cavity traverses in front of the loading station 44, continuous loading. The loading station 44 may be configured to load every other cavity that traverses in front of the loading station 44 or some other sequence such as every third cavity or every fourth cavity that traverses in front of the loading station 44, discontinuous loading.

The unloading station 46 may be configured to remove one or more articles from the transfer device 48. More specifically, an article 10 may traverse to the unloading station 46. The unloading station 46 may accept the article 10 and, subsequently, transfer, such as by a conveying device, the article to a downstream process. The unloading station 46 removes the article 10 from a cavity 42 of the array of cavities 38. As illustrated in FIG. 2, the articles 10 traverse to and are unloaded by the unloading station 46 in a direction indicated by arrow U. The unloading station 46 may be configured to unload each article 10 as the cavity traverses in front of the unloading station 46, which may be referred to as continuous unloading. The unloading station 46 may be configured to unload every other cavity that traverses in front of the unloading station 46 or some other sequence such as every third cavity or every fourth cavity that traverses in front of the unloading station 46, which may be referred to as discontinuous loading.

As illustrated in FIG. 2, the transfer component 24 including the transfer material 22 traverses to the transfer device 48. The transfer component 24 may be positioned adjacent to the array of cavities 38 and extend about a portion of the outer circumferential surface 69 of the drum 43. The transfer component 24 may be positioned such that the transfer material 22 is positioned adjacent to the article 10 disposed in the cavity 42 such that the transfer material 22 may be transferred to a face of the article 10. As the transfer component 24 traverses about the transfer device 48, a portion of the transfer component 24 may be sealed to a portion of the cavity 42. The transfer component 24 may be sealed such that the transfer material 22 is in position to be transferred to the article 10. As the sealed transfer component 24 continues to traverse in the machine direction, the article 10 and the transfer material 22 may contact one another. Contacting the article 10 and the transfer material 22 may include modifying, such as by deforming, a portion of the transfer component 24 such that the transfer component 24 conforms to the article 10, and/or traversing, also referred to herein as moving, the article 10 in a direction toward the transfer component 24. It is to be appreciated that to contact the article 10 and the transfer component 24 any one of the following may occur: only the transfer component may be moved, such as by deformation, and the article 10 may remain stationary; the transfer component may be moved, such as by deformation, and the article may be moved; or only the article 10 may be moved into the transfer component 24.

The cavity 42 including the portion of the transfer component 24 having the transfer material 22 thereon in contact with a portion of the article 10 may traverse to an energy source 50, such as illustrated in FIG. 2. The energy source 50 may be positioned adjacent to the transfer device 48 such that the cavity traverses in front of, or adjacent to, the energy source 50. The energy source is optional, and the necessity may depend, in part, on the type of adhesive and/or material (s) used. Certain transfer materials may require an energy source 50 to cause or to aid in the transfer material 22 being transferred from the transfer component 24 to the article 10. The energy source 50 may be used for curing any curable adhesive, ink, or varnish, which may have adhesive properties. The energy source 50 may also be used to sterilize the content of the article. For example, an Electron Beam may be used for at least one of curing and sterilizing during the process disclosed herein. The energy source may be located adjacent to (that is, on the same side as) the transfer surface 24A of the transfer component or adjacent to (that is, on the same side as) the back surface 24B of the transfer component. The apparatus 20 may include one or more energy sources 50.

The transfer material 22 may be transferred from the transfer component 24 to a face, including one or more surfaces 12, of the article 10. Once the transfer material 22 has been transferred to the face of the article 10, the transfer component 24 may be removed from contacting the article 10. The transfer component 24 may be free of the transfer material after the transfer material has been transferred to the face and/or one or more surface of the article. The face of the article 10 including the transfer material 22 may be referred to herein as a decorated portion. The transfer component 24 may traverse about an idler 25 and away from the transfer device 48. The article 10 including the decorated portion may traverse toward the unloading station 46. The article 10 including the decorated portion may be unloaded by the unloading station 46 or the article 10 including the decorated portion may traverse past the unloading station 46. The article 10 including the decorated portion that is not unloaded at the unloading station 46 may traverse past the unloading station 46 and may continue about a second revolution of the transfer device 48. During the second revolution of the transfer device 48 the decorated portion of the article 10 may receive additional decoration or a face of the article that does not include the decorated portion may be decorated on the second revolution. The article may continue about the transfer device for any number of revolutions.

It is to be appreciated that one face of the article may be decorated by a first transfer device and a second face of the article may be decorated by a second transfer device. More specifically, the first transfer device may decorate a first face of the article. The decorated article may then be transferred to a second transfer device. The second transfer device may decorate a second face of the article. It is also to be appreciated that the second transfer device may be used to apply additional decoration to the first face of the article. Any number of transfer devices may be used to apply the transfer material to the article.

The apparatus 20 illustrated in FIG. 2 is described as a top view. More specifically, the axis of rotation 68 of the drum is oriented vertically as illustrated. However, the entire apparatus 20 may be reoriented such that the axis 68 of the drum 68 is horizontal. It is to be appreciated that the apparatus 20 may also be oriented in any configuration between horizontal and vertical.

Figure 3A:
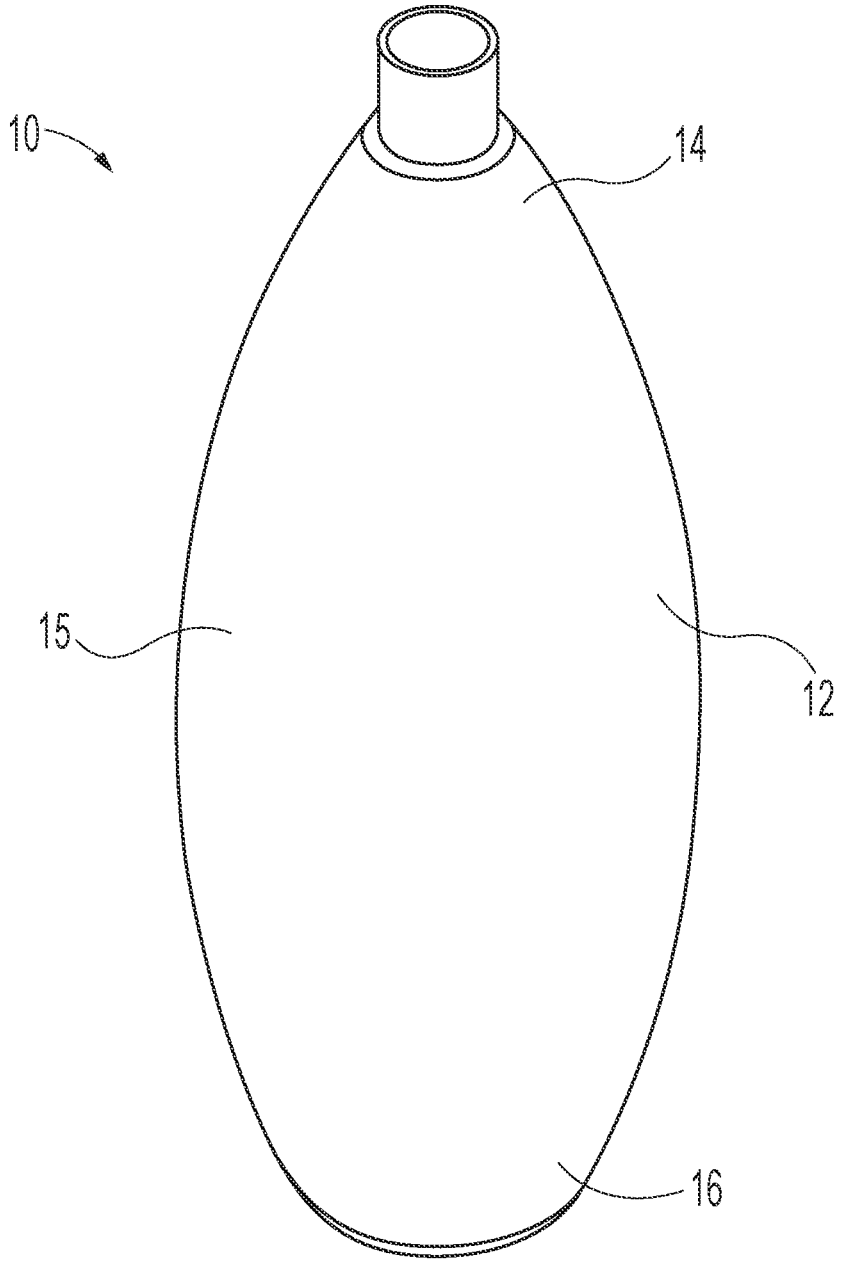
FIG. 3A is a perspective view of an article.
Figure 3B:
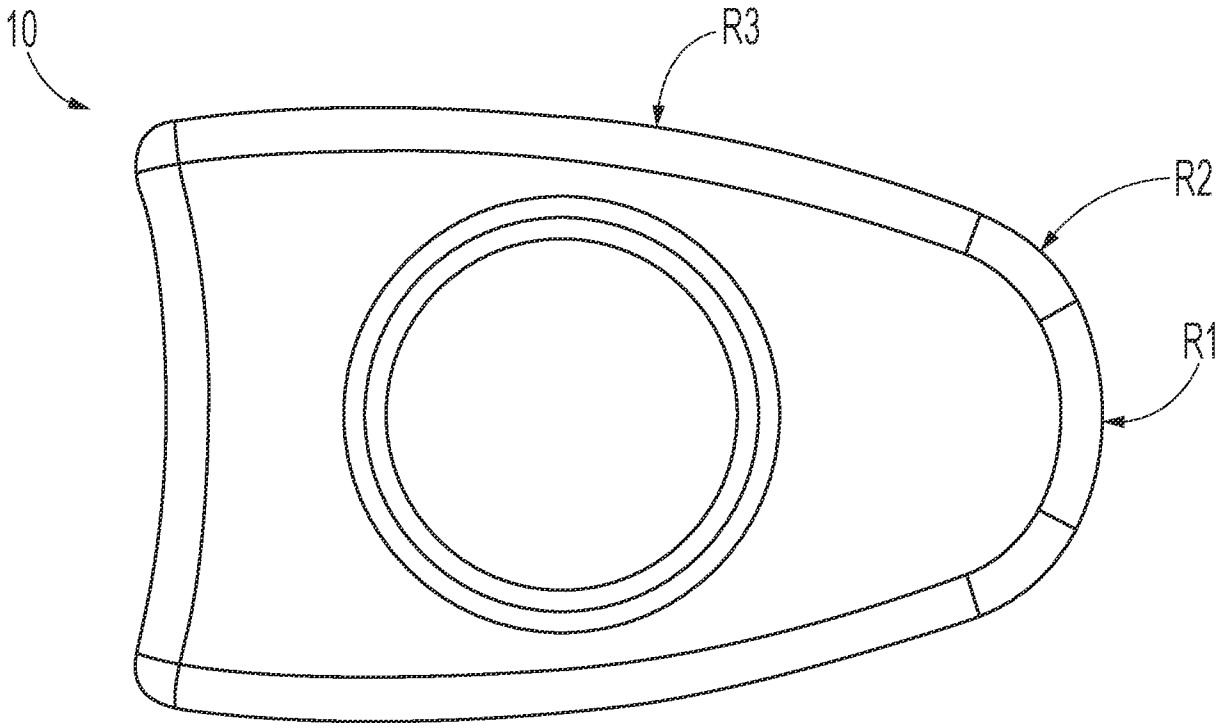
FIG. 3B is a schematic top view of an article such as a bottle.
Figure 4B:
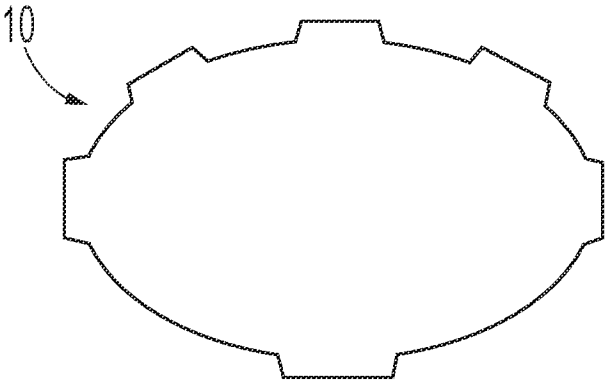
FIG. 4B is a schematic cross-sectional view of an article.
Figure 4D:
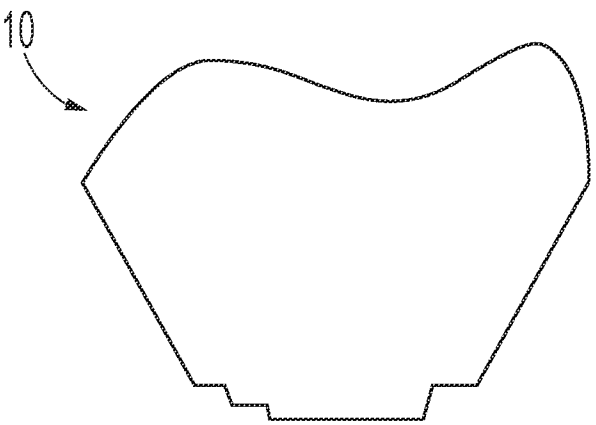
FIG. 4D is a schematic cross-sectional view of an article.
Figure 4A:
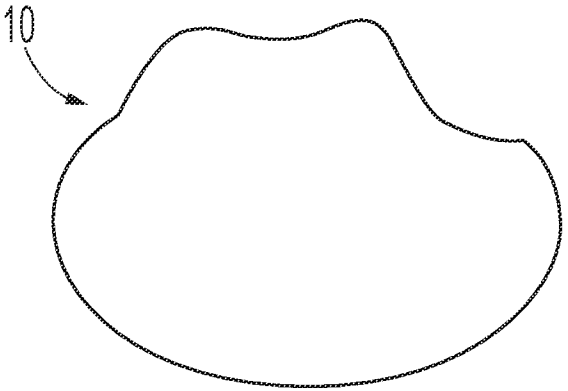
FIG. 4A is a schematic cross-sectional view of an article.
Figure 4C:
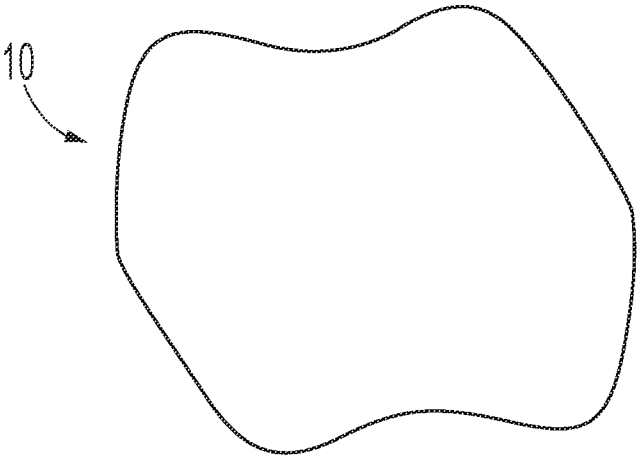
FIG. 4C is a schematic cross-sectional view of an article.

The apparatus 20 may be used to apply a transfer material 22 on numerous different types of articles 10, such as illustrated, for example, in FIGS. 3A and 3B. These articles may be three-dimensional articles and such articles may include but are not limited to: containers or packages such as bottles, boxes, cans, and cartons; laundry dosing balls; razors; components of consumer products such as razor blade heads and handles; sprayer triggers; tubs; tubes including, but not limited to tampon tubes; and deodorant stick containers. The articles may include primary packages for consumer products, including disposable consumer products. Additional articles may include components of containers or packages including, but not limited to: bottle caps, closures, and bottle pre-forms that are subsequently blown into the form of a finished bottle.

The apparatus 20 may be used to apply material to empty containers, partially filled, or filled/full containers including closed and open containers. The method and apparatus 20 may be used to apply material (e.g., decorate) to the containers, the closures, or both, separately or simultaneously. The containers may have a rigid, flexi-resilient, or flexible structure in whole or in part. In some cases in which the articles are flexible or flexi-resilient and have an interior which is empty (such as in the case of some bottles), it may be desirable to blow fluid, such as air or other gas, into the interior of the article in order to pressurize the article, above atmospheric pressure, so that the surface of the article does not yield excessively during the transfer process described herein.

For example, at least a portion of the surface of the article to which a substance is to be applied may be flexible, wherein the interior of the article, which is hollow or partially hollow, is pressurized prior to transferring the material onto the surface of the article with the result that the portion of the surface of the article to which a material is to be applied is less flexible while being pressurized. Containers such as bottles may be made by any suitable method including, but not limited to blow molding. Such containers may have a threaded opening, an opening configured to accept a snap-on closure, an adhered closure, or any other suitable type of opening. The closures may be made by any suitable method including, but not limited to injection molding, blow molding, and compression molding. Such containers may be capped or uncapped with a closure when the transfer material is applied. The transfer material may be applied to the container after the container is filled and has a closure applied thereto. For example, the container may be injection molded, blow molded, or compression molded, and the container may be filled with a fluent, semi-solid, or solid material and have the closure applied thereto. In such a process, the material may be applied to the container and/or closure at the end of a manufacturing line.

The articles may be made of any suitable material, including but not limited to: plastic, metal, and/or cardboard. If the articles are made of plastic, they may be made of any suitable plastic. Suitable plastics for bottles, for example, may include, but are not limited to: polypropylene, polyethylene terephthalate (PET), high density polyethylene (HDPE), and low density polyethylene (LDPE).

The articles 10 may have at least two opposing ends. For example, a bottle may include a first end portion 14 and a second end portion 16 opposite the first end portion, such as illustrated in FIG. 3A. The first end portion 14 may include an open top, which may allow a fluid or other material to be introduced into the article, and the second end portion 16 may include a base. The articles 10 will also include one or more faces 15 and each face may include one or more surfaces 12. The one or more faces 15 may extend from the first end portion 14 to the second end portion 16 and each face 15 may have any number of surfaces 12. The articles 10 may be solid as in the case of some razor blade handles, or hollow or partially hollow in the case of bottles, for example. The one or more surfaces of the articles 10 may be flat (planar) or curved. The entire face need not be either flat or curved and may be made up of several surfaces that are flat or curved. For example, the face of the articles 10 may have: surfaces that are flat; surfaces that are curved; or, the surface may have both flat portions and curved portions. The face may be curved or flat depending on the axis in which the surface is visualized. For example, the article may be curved along a longitudinal axis and flat along a transverse axis. In the case of bottles, for example, at least a portion of the face may have a convex curvature. Further, some articles may have a face in which at least a portion thereof has a concave curvature.

The method and apparatus may be used to apply the transfer material 22 to uniformly cylindrical three-dimensional articles and to non-cylindrical three-dimensional articles, which include surfaces of articles that do not form part of a cylindrical object. For non-cylindrical three-dimensional articles, one or more of the surfaces may have different configurations. Such surfaces may, as a result, be more complex and difficult to apply transfer materials to than cylindrical surfaces, according to known means. It may be desirable to apply a transfer material to articles that have non-ruled surfaces. A non-ruled surface may be described as one that has a Gaussian curvature that is not equal to zero, such as illustrated in FIG. 3A. The article may have an exterior surface having a portion that has simultaneous radius of curvature in two or more planes wherein the absolute value of the Gaussian curvature of said surface or a portion of the surface is greater than or equal to 43 $m^{-2}$. The absolute value of the Gaussian curvature of such a surface or a portion of the surface is greater than or equal to 172 $m^{-2}$. The method and apparatus may be used to apply a transfer material onto the articles that have complex geometries. For example, the faces may include surfaces with curves that have more than one axis of curvature.

For example, the method and apparatus may be used to apply a transfer material onto two or more surfaces of an article that each have a radius of curvature. At least two of the two or more surfaces may be at least partially separated by an intermediate surface that has a lesser radius of curvature or a greater radius of curvature than at least one or the two surfaces. The intermediate surface may extend the full length of the two or more surfaces and form a boundary therebetween or, the intermediate surface may only extend a portion of the length between the two or more surfaces. The two or more surfaces may have any suitable radius of curvature. The radius of curvature of the two or more surfaces may be the same as the other such surfaces, or different. Such radii of curvature of the two or more surfaces may range from a radius that is greater than that of the intermediate surface up to an infinite radius of curvature in the case of a flat portion (or any range therebetween). For example, the two or more surfaces and the intermediate surface may all be located on one of the first end portion 14, the second end portion 16, or a face between the first end portion 14 and the second end portion 16, which may be a side of an article such as a container. The intermediate surface may be a feature on said exterior face that has a lesser radius of curvature than the two or more surfaces. The feature including the intermediate surface may protrude outward from the exterior of the article. The feature may be recessed into the exterior of the article. These features may have any suitable configurations. An example of a feature that protrudes outward from the exterior face is a ridge. An example of a feature that is recessed into the exterior face is a groove. Non-limiting examples of an article having such features are shown in FIGS. 4A-4D. FIGS. 4A-4D illustrate a cross sectional view of exemplary articles. An article may have more than one feature as described herein. An article may have more than two surfaces with an intermediate surface therebetween that have a transfer material thereon as described herein. The at least two or more surfaces may be located on different ones of the first end portion, the second end portion, and faces of the article, and the intermediate surface may include an edge between the two or more surfaces.

The apparatuses and methods described herein may, thus, be used to provide a transfer material that wraps around at least one or more surfaces and/or one or more faces of an article. For example, the transfer material may be disposed on three or more surfaces. The transfer material may be disposed on two or more faces of the article. The apparatus and methods herein may be used to provide a multi-sided application of the transfer material. The transfer material may, thus, provide a continuous image on at least portions of two or more surfaces, which may include one or more faces, of an article. The faces of an article may have an intermediate surface of the article therebetween that has a lesser radius of curvature than the other surfaces of the faces of the article, such as illustrated in FIG. 3B.

As illustrated in FIG. 3B, the intermediate surface has a radius of curvature R2 that is less than both R1 and R3. The two or more surfaces with radii R1 and R3 may have any suitable radius of curvature. Such radii of curvature may range from a radius that is greater than that of the intermediate surface up to an infinite radius of curvature in the case of a flat portion of the exterior face, or any range therebetween. It is to be appreciated that when the intermediate surface is described as having a lesser radius of curvature, the intermediate surface may have any suitable radius of curvature. The radii of curvature for the intermediate surface may range from greater than or equal to zero to less than or equal to about any of the following: 60 mm, 40 mm, 20 mm, 15 mm, 10 mm, 5 mm, 2 mm, 1 mm, or 0.1 mm, specifically reciting all 0.1 mm increments within the specified ranges and all ranges formed therein and thereby. The radius may be effectively zero if the faces being associated with radii R1 and R3 met at a right angle that was defined by a sharp, non-rounded edge. The transfer material may be wrapped around any two or more faces or surfaces of the article. Application of the transfer material in this manner may provide the transfer material and the article with a relatively cleaner appearance without the visible edges typically seen on the front or back of articles which have heat transfer labels applied thereto. Generally, heat transfer labels require a ruled surface due to the structure of the heat transfer labels and the method by which they are applied. Heat transfer labels require an adhesive backed label that includes a carrier, which is a web that carries the decoration, such as ink, of the label. The carrier has an outer edge that substantially surrounds any and all of the decoration to be applied to the article. Heat transfer labels generally require a heat source and a physical source to apply pressure to get the label to adhere to the article.

Figure 5:
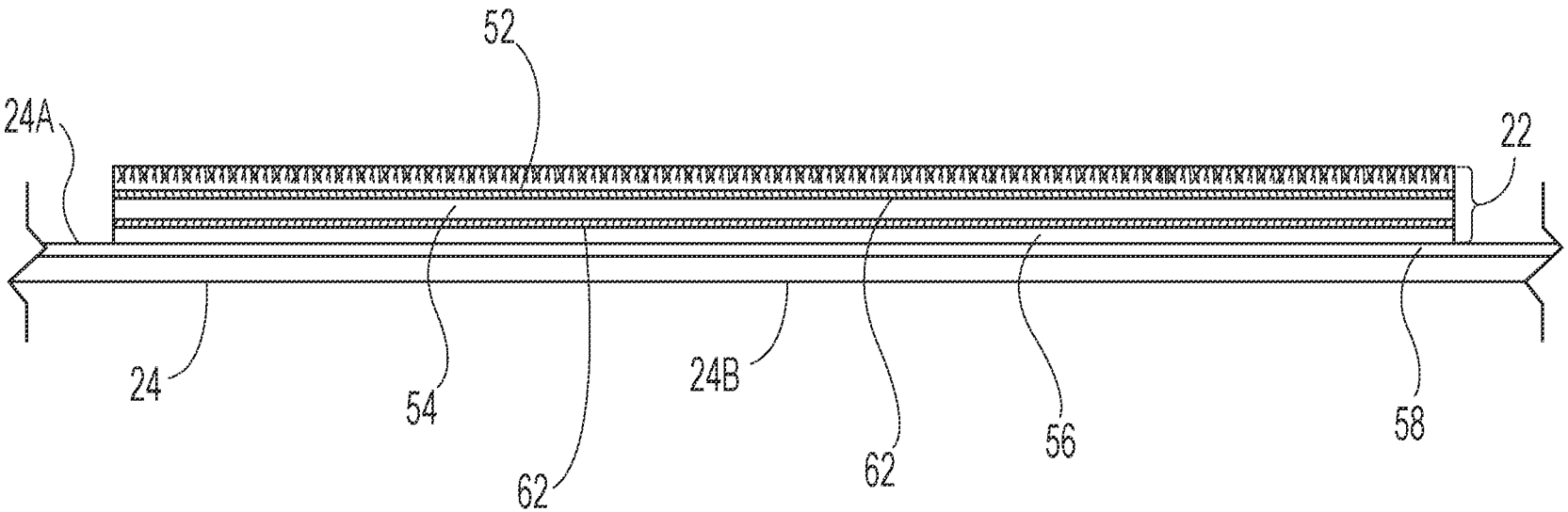
FIG. 5 is a schematic side view of a transfer component having a transfer material thereon.

As described herein, the transfer component 24 may be used to accept the transfer material 22 and aid in transferring the transfer material 22 to the article 10. The transfer component 24 may be any suitable component that is capable of receiving one or more materials that are deposited on the transfer component 24 to form a transfer material 22 and then transferring the transfer material 22 to at least a portion of the face of an article 10. The transfer component 24 may be discrete or continuous. The transfer component 24 may be one or more discrete components having the properties described herein such that each discrete component receives a transfer material for application to a single article 10. The transfer component 24 may be a continuous component. The term "continuous", as used herein, refers to a transfer component that receives two or more transfer material deposits for application to different articles. Typically, a continuous transfer component 24 will be capable of receiving a plurality of transfer material deposits for application to different articles. A continuous transfer component 24 may have a machine direction length that is greater than the dimension of the article to which the transfer material 22 is to be transferred. Continuous transfer components may be in a number of different forms. For example, a continuous transfer component 24 may be in the form of a web that is unwound from a supply roll, and after use, rewound on a take-up roll. The continuous transfer component 24 may be in the form of an endless, closed loop, belt. FIG. 5 illustrates a portion of a transfer component 24 that could be in either of these forms.

The transfer component 24 may be a single use component or a reusable component. For a single use transfer component 24, once the transfer material 22 is transferred from the transfer component 24 to an article 10, the same portion of the transfer component that contained the transfer material is not used to transfer another transfer material to another article. The transfer component 24 may be disposable after use or recycled in an environmentally compatible manner. The transfer component 24 may be reusable so that the same portion of the transfer component 24 may be used to receive and transfer more than one transfer material to different articles. When the transfer component 24 is reusable, it may be necessary and/or desirable to clean the transfer component 24 between the transfer of one transfer material 22 and the receipt of another transfer material 22 thereon. Therefore, the transfer component 24 may pass through a cleaning station after the transfer component 24 releases from the transfer material.

The transfer component 24 may have any suitable properties. It may be desirable for the transfer component 24 to be substantially incompressible under the forces associated with carrying out the method described herein. The transfer component 24 may be in the form of a web or in the form of a belt. The web or belt may have two opposing surfaces that define a thickness therebetween. These surfaces may be referred to as a front or transfer surface 24A and a back surface 24B. The web or belt may be relatively thin and/or flexible so that the web or belt may conform to the surface 12 of the article 10 without the need to compress or with minimal compression to the surface of the transfer component 24. The thickness of the transfer component 24 may change as the transfer component conforms to the surface 12 of the article 10. Both surfaces 24A and 24B of the transfer component 24 may flex in a similar manner when the transfer component 24 and the article 10 are brought into contact with each other.

A transfer component 24 in the form of a web or belt may have one or more portions that are unsupported, such as a span without any backing, between the transfer material receiving areas on the surface of the same. This characteristic of a transfer component 24 in the form of a web or belt is one of the ways such a web or belt transfer component is distinguishable from offset blankets, such as described in U.S. Pat. Nos. 6,920,822 and 7,373,878, that are mounted on cylinders. Generally, offset blankets are discrete surfaces and ink, first, gets deposited onto the offset blanket, and secondly, the ink is transferred from the discrete offset blanket to an article. Due to the structure of the offset blanket, a ruled article surface is required.

The transfer component 24, whether discrete or continuous, may be extensible in at least one direction. For example, the transfer component 24 may be extensible in one direction and in a direction perpendicular thereto in the plane of the surfaces of the transfer component 24. A continuous transfer component 24 that moves during the process will have a machine direction MD oriented in the direction of movement and a cross-machine direction CD perpendicular to the machine direction in the plane of the surfaces of the transfer component. The transfer component 24 may be extensible in the machine direction and/or the cross-machine direction. The transfer component 24 may be omni-direction extensible (extensible in all directions in the plane of the surfaces of the transfer component). It is to be appreciated that the transfer component 24 may be extensible in one direction, but due to the Poisson effect, for example, may contract in another direction, such as in a direction perpendicular to the direction in which it is extended, in the plane of the surfaces of the transfer component.

The transfer component 24 may be extensible in any suitable amount under the forces associated with conforming the transfer component to the surface of the articles 10 during the process described herein. The transfer component 24 may have a first length, also referred to herein as an initial length, measured along its surface prior to contacting the article 10 and a second length measured along its surface after contacting and conforming to the article 10. The first length may be less than the second length. The extensibility of the transfer component 24 allows the change in length from the first length to the second length. The transfer component 24, or at least the portion thereof configured to contact the surface of an article, may be extensible in amounts greater than about 0.01% up to the point of plastic deformation of the transfer component 24, or in some cases, may even approach, but not reach the point of ultimate failure of the transfer component 24. The transfer component 24 or at least the portion thereof in contact with the surface of an article may be extensible such that the transfer component 24 may increase a dimension in at least one direction by between about 0.01% to about 500%, or between about 0.01% to about 300%, specifically reciting all 0.01% increments within the specified ranges and all ranges formed therein or thereby. The transfer component 24 may be elastically extensible such that it will not only extend under force but will return back to (or toward) its original dimensions after one or more forces are removed. For example, an elastically extensible transfer component 24 is useful when portions of the transfer component 24 are deflected into a cavity.

The transfer component 24 may be made of any suitable material. The material may depend on the type of transfer component, and other desirable properties for the transfer component, such as being compressible or substantially incompressible. Suitable types of transfer components include, but are not limited to: films, belts, and discrete components. A transfer component 24 made from film may include, but not limited to, one or more of the following materials: polyethylene, polyester, polyethylene terephthalate (PET), and polypropylene. The transfer component may be made from materials that include, but are not limited to: rubber, rubberized materials, polyurethanes, and felt. At least some of such materials may be low surface energy materials having a surface energy of less than or equal to about 45 dynes/cm.

The transfer component 24 may be of any suitable thickness. If the transfer component 24 is in the form of a film, the film transfer component 24 may have a thickness within a range that is greater than about 0.0025 mm to less than or equal to about 5 mm, or less than or equal to about 3.2 mm, or less than or equal to about 2 mm, or less than or equal to about 1.5 mm, or any narrower range therebetween. A film may, for example, have a thickness in the range of from about 0.0025 mm to about 0.025 mm. It may be desirable for the transfer component 24 to have a relatively lower thickness when the article 10 has significant surface features such as high levels of localized curvature, so that the transfer component 24 is better able to conform to the configuration of the surface of the article 10. In addition, it may be desirable for the transfer component 24 to have a relatively greater thickness if it is reusable, than if it is disposable. A transfer component 24 in the form of a durable belt, for example, may have a thickness in the range of from about 0.25 mm to about 1.5 mm. The durable belt may have a thickness greater than 1.5 mm to offer some compressibility.

The surface 24A of the transfer component 24 should be capable of receiving a deposit of a material thereon. For example, the transfer component 24 may receive a material first deposited on the transfer component 24 by printing, and the surface 24A of the transfer component may be described as a "print-receiving" surface. The surface 24A of the transfer component 24 may have an optional release coating thereon to facilitate transfer of the transfer material 22 to the article. Suitable release coatings include but are not limited to: silicone and wax. The release coating will typically be applied to the transfer component 24 before any materials are deposited on the transfer component 24. The release coating will typically remain on the transfer component 24 and will not be part of the transfer material 22 that is transferred to the article 10. The release coating may be applied such that the release coating covers substantially all of the surface of the transfer component 24 or the release coating may be applied only in those areas that the transfer material, such as the ink, adhesive, and/or varnish, is applied to the transfer component. The release coating may be applied by the deposition device(s) or the release coating may be applied prior to the transfer component being supplied to the deposition devices or the release coating may be incorporated into the manufacture of the transfer component.

The material deposition devices, also referred to as deposition device(s), 26 may deposit any suitable material, also referred to as a substance, on the transfer component 24. The apparatus 20 may comprise any suitable number, arrangement, and type of deposition device(s) 26. For example, the apparatus may comprise between 1-20, or more, deposition device(s) 26. Thus, there may be a plurality of deposition devices 26. The deposition devices may each deposit the same materials or different materials.

The deposition device 26 may be part of the apparatus 20 and process for transferring the transfer material 22 onto the articles 10, such as illustrated in FIG. 2. Thus, the deposition device may be "in-line" with the transfer process. Alternatively, the deposition of the transfer material 22 onto the transfer component 24 may be performed using a separate apparatus and process from the process for transferring the transfer material 22 onto the surface of the article 10. For example, the material deposition portion of the process may be a separate process, such as a printing process, that is unconnected to the equipment used to transfer the transfer material 22 onto the surface of the article 10. That is, the printing of the substance may take place off-line. Thus, it is possible to deposit the transfer material 22 onto a transfer component 24 and to wind the transfer component with transfer material deposits thereon onto a roll. Similarly, discrete transfer components including the transfer material may be stacked. The transfer component roll or stack of discrete transfer components with transfer material deposits thereon may be brought into the process which transfers the transfer material from the roll onto the articles.

The deposition devices may either be of a type that contacts the transfer component 24 directly or by indirectly applying pressure to the transfer component 24 through the material ("contacting"), or of a type that does not contact the transfer component 24 ("non-contacting"). For the purposes of this disclosure, spraying ink on a transfer component is considered to be non-contacting. The component 25 for supporting the transfer component 24 during material deposition may include any type of component that is capable of serving such a purpose. The component 25 providing the support surface may include, but not be limited to: a cylinder, a belt, or a plate (e.g., an arcuate plate).

The deposition device 26 may be any suitable type of device including, but not limited to: offset printing systems, gravure printing systems, print heads, nozzles, and other types of material deposition devices. In the case of print heads, any suitable type of print heads may be used including, but not limited to piezo inkjet print heads, thermal inkjet print heads, electrostatic print heads and/or printing valve print heads. The print heads may be a drop-on-demand type of deposition device. By "drop-on-demand", it is meant that the print heads create droplets of ink at the nozzle only when needed such as to form a design or pattern in the form of words, figures or images (e.g., pictures). The print heads may also be "continuous" meaning drops are continuously formed at the nozzles, however only desired drops leave the print head to form the intended pattern. Ink jet print heads are typically digitally actuatable and may digitally print patterns provided by a computer. Thus, ink jet print heads are a form of a digital printing device that may digitally print material to produce the desired pattern on a portion of the transfer component 24.

Suitable materials or substances include, but are not limited to: inks (including UV-curable inks, E-beam curable inks, water-based inks, and solvent-based inks), varnishes, coatings (i.e. a release coating), and lotions. The material may be deposited in any suitable form. Suitable forms include, but are not limited to: liquids; colloids including gels, emulsions, foams and sols; pastes; powders; and hot melts (the latter being solids that may be heated to flow). For example, the deposition device may deposit a material that is in a powder form such as a toner used to form printed images. The powder my consist of granulated plastic, carbon powder, iron oxide and other organic and inorganic compounds. The powder may be heated beyond its melting point to form a fused material that is continuous and may be easily manipulated to transfer onto various substrates.

The material may be deposited in any suitable pattern. Suitable patterns may be regular, irregular, or random, and include, but are not limited to: words (text), figures, images, designs, an indicium, a texture, a functional coating, and combinations thereof. The material 22, such as the ink(s), may be applied to the transfer component 24 in a predetermined pattern. The term "predetermined pattern", as used herein, refers to any type of pattern or design including but not limited to words, figures (e.g., pictures), images, or indicia that is determined prior to the initiation of application, which may include, for example, printing. The predetermined pattern may include one or more transfer materials. The predetermined pattern includes discrete portions that together present an integrated or related pattern of one or more words, figures, images, or indicia. Each of the discrete portions of the predetermined pattern are made up of a transfer material, which includes one or more layers of materials, as discussed herein. The two or more layers of materials that make up the transfer material all have substantially the same dimensions for a discrete portion. For example, a discrete portion may include a transfer material including an adhesive layer, an ink layer, and a varnish layer. For the discrete portion the adhesive layer, the ink layer, and the varnish layer will have substantially the same dimensions. Each discrete portion of the predetermined pattern is joined to the same article, but those discrete portions are otherwise unconnected, discrete, from one another. In another example, the adhesive layer, a first ink layer, and the varnish layer will have substantially the same dimensions and a second ink layer has a different dimension than the first ink layer. In another example, at least two of the layers will have substantially the same dimensions and a third layer will have a different dimension.

The apparatus 20 may include one or more adhesive deposition devices 28. The adhesive deposition device 28 is optional. If the material (such as ink or varnish) previously deposited on the transfer component 24 has sufficient adhesive properties to adhere to the surface 12 of the articles 10, a separate adhesive deposition device may not be necessary. The adhesive deposition device 28, if present, may be any suitable type of device for depositing an adhesive onto at least a portion of the previously deposited material(s) and/or the transfer component 24. Suitable adhesive deposition devices 28 include, but are not limited to: print heads, nozzles, and other types of deposition devices.

The adhesive may be any material that is suitable for adhering the transfer material 22 to the articles 10 when the transfer component 24 is brought into contact with the surface 12 of the articles 10. The adhesive enables, alone or in part, the transfer material 22 to be transferred from the transfer component 24 to the surface 12 of the articles 10. For example, some adhesives may need to be activated to enable transfer to the article. Suitable adhesives include, but are not limited to: pressure sensitive adhesives, radiation, such as UV, or Electron Beam curable adhesives, water-based adhesives, solvent-based adhesives, heat setting (or thermally activated) adhesives, and two-part or multi-part adhesives (for example two-part epoxy adhesives). The adhesive may be of a non-heat activated (or thermally-activated) type, such as in the case of heat transfer labels. The adhesive may be formulated so that the adhesive composition will cure sufficiently to provide the transfer within the allotted process time. For example, the allotted process time may be from about 0.1 second to about 10 seconds range. In the case of two-part epoxy adhesives, the first part may be applied by one deposition device and the second part may be applied by a second deposition device. An adhesive system may also be applied such that, a first part of the adhesive may be applied to the transfer component 24 and a second part of the adhesive may be applied to a portion of the article 10. With any of the adhesive systems, it may be desirable to at least partially cure the adhesives prior to contacting the article in order to control squeeze out/flow of the adhesive.

The adhesive may have a sufficiently low tack, a first level of tackiness, during the initial stage of contacting the article 10 with the transfer component 24 or contacting the transfer component with the article so that at least portions of the transfer material 22 may slip along the surface 12 of the article 10 in order to conform to the surface of the article without damage to the transfer material 22 or the transfer component 24. If the adhesive is a type that may be cured, at this initial stage, the adhesive may be uncured, or only partially cured. Once the transfer component 24 with the transfer material 22 thereon is conformed to the surface of the article 10, pressure may be applied to the transfer component in a direction substantially normal to the surface of the article in order to conform and/or adhere the transfer material 22 to the surface of the article 10. It may be desirable for the ink component to be fully cured before normal pressure is exerted on the transfer component so that the ink will not undesirably spread, distorting any image, etc. and/or causing the ink to ooze out of the transfer material.

The apparatus 20 may include an embellishment device 60. The embellishment device is a device that may be used to add a visual, tactile, functional, or olfactory effect by means of material deposition that is applied directly, or transferred, such as by transferring from the transfer component, to an article 10 or by transforming a property of an article, or combinations thereof. An example of transforming a property of an article without transferring a material to the surface of the article is imparting an image on the surface of an article by a laser. A single embellishment device may be used to apply a single decorative effect or multiple decorative effects. Alternatively, multiple embellishment devices may be used to apply the decorative effect(s). The material deposited by the embellishment device may occur before or after the deposition of material by the material deposition device on the transfer component 24, or even directly onto the articles before or after the transfer material 22 is applied to the articles 10.

The embellishment device may deposit a metallic substance on the transfer component 24 and/or onto one of the substances already disposed on the transfer component. For example, the metallic substance may be deposited indirectly on the transfer component 24. A metallic substance may be used to provide the article 10 with a metallic effect. The metallic material may include any suitable type of metallic material including, but not limited to: a metallic foil; printed metallic ink; or sintered metal. If the metallic material includes a metallic ink, it may be printed by any of the processes described herein for printing the ink component. A metallic substance may be deposited on the transfer component 24 such as described in U.S. Patent Application No. 62,664,967 filed May 1, 2018 and U.S. Pat. No. 15,992,265 filed May 30, 2018. The metallic substance, which may include ink, may be dried using Zenon flash.

The embellishment device may add a tactile effect to the transfer material 22 and, thus, to the article 10. The tactile effect may include a buildup texture that is transferred to the surface 12 of the article 10. The texture may be created by depositing a textured substance on the transfer component 24 before, during or after depositing other substances on the transfer component 24. Alternatively, the tactile effect may be created by using a textured transfer component 24.

For example, to create a tactile and/or visual effect into the transfer material, a curable material, such as varnish, may be disposed on the transfer component. A pattern may be imprinted, such as by stamping, the curable material. The curable material may be cured such that the pattern is hardened on the transfer component so as to retain the pattern. Upon curing the curable material, one or more materials may be deposited on the cured pattern. The transfer materials may include varnish, ink, adhesive, as discussed herein, deposited on the patterned, cured material. When the transfer material is transferred to the article the transfer material takes on the pattern of the patterned, cured material. The patterned, cured material is not transferred to the article. The transfer material disposed on the article has an optical/tactile effect.

It is to be appreciated that the material deposition device, the adhesive deposition device, and the embellishment device may each apply different materials and be substantially the same type of equipment. For example, each of the material deposition device, the adhesive deposition device, and the embellishment device may include one or more nozzles used to deposit material onto the transfer device.

FIG. 5 illustrates one example of a transfer material 22 on a portion of a transfer component 24. The components of the transfer material 22 may include: an optional adhesive (or varnish or ink with adhesive properties) 52; an ink component, which may be in the form of artwork, an image, etc. 54; and, an optional protective coating or component (such as a clear varnish) 56. An optional additive or release agent 58 may also be applied to the transfer component 24. The transfer component 24 is in the form of a relatively thin film or belt. In addition to the components discussed herein and illustrated, other optional components may be included in the transfer materials 22. For example, the ink component 54 may be formed by depositing one or more colored inks, such as CMYK inks, and an optional base layer, which may be white or any suitable color, may be provided between the optional adhesive 52 and the ink component 54. In addition, an optional metallic material 62 may be provided between the optional adhesive 52 and the ink component 54, or between the ink component 54 and the optional protective component 56. It should be understood, however, that one or more of these optional layers may be omitted, and that in its simplest form the transfer material 22 may only consist of an ink component (such as a varnish or an ink layer) 54 if the ink component 54 has sufficient adhesive properties to adhere to the surface 12 of the article 10, and if the ink component has sufficient protective properties and wear resistance that it does not require a protective component. The transfer material 22 will typically be free of any release paper, such as that used to cover adhesive on decals. The transfer material 22 may be free of a carrier, such as a film layer, paper layer, or foil layer, that remains on the article after the transfer material is applied to the surface of an article, such as in the case of heat transfer labels. As previously discussed, the transfer material forms a predetermined pattern including discrete portions.

It is to be appreciated that all of the components illustrated in FIG. 5 may, but need not have, the same dimensions and/or plan view configurations. Any of these components may have greater or lesser dimensions in any direction than any of the other components. However, it may be desirable for the optional adhesive component 52 (or ink layer with adhesive properties) to have dimensions that are equal to or greater than the underlying layers as arranged on the transfer component 24, which may become overlying layers on the surface of the article, so that the underlying layers will be adhered to the surface 12 of the article 10.

The process herein may be described in terms of depositing one or more of the materials described above on the transfer component 24. It should be appreciated, however, that it is not necessary that a particular material be deposited directly on the surface 24A of the transfer component 24. The depositing of the material on the transfer component 24 may include depositing the material directly on the surface 24A of the transfer component 24, or indirectly depositing a material on the surface 24A of the transfer component 24, such as by depositing one material (for example an adhesive) on top of another material (for example an ink) that is already on the surface 24A of the transfer component 24.

Although the components of the transfer material 22 are shown as layers in FIG. 5, one or more of these components may, but need not be in the form of a layer. For example, in the ink component 54, some ink droplets may stay discrete; some others may merge together to form a film-like structure. The components of the transfer material 22, if deposited in a form which may need to be cured, may also be in various states ranging from non-cured to fully cured. It may be desirable for the ink to be in the form of a pre-formed image before the transfer of the transfer material 22; otherwise, the desired pattern of ink (e.g., the image) may degrade during transfer. As used herein, the term "pre-formed" image refers to a dried image in the case of solvent or water-based inks, or a fully cured or partially cured image in the case of curable inks. The ink may therefore be pre-formed and the adhesive may be non-cured, or only partially cured. A transfer of a pre-formed ink image by the transfer material differs from ink jet printing directly on an article wherein the droplets of ink are deposited on an article and then dried or cured.

The release agent 58 may be used to ensure that the transfer material 22 releases cleanly from the transfer component 24 and transfer to the surface 12 of the articles 10. The release agent 58 may be continuous in the machine direction as shown in FIG. 5, or it may be in the form of discrete patches that only underlie the transfer material 22.

The transfer device 48 may be any suitable type of device for traversing the article(s) 10 so that the articles 10 may contact, or be contacted by, the transfer component 24 and have the transfer material 22 transferred to the articles 10. The term "transfer device", as used herein, refers to devices that move articles generally, and is not limited to drums. Suitable transfer devices may include, but are not limited to: turret, star wheel, endless loop conveyors, robots, and linear conveyors which may be in the form of tracks, belts, chains, and the like, puck conveyors, and tracks with independently controllable magnetic pucks.

As illustrated in FIGS. 2 and 6, the transfer device 48 may include a drum 43 and any suitable type of holder for holding the articles 10 thereon. As previously discussed with respect to FIG. 2, the transfer device 48 may include a drum 43 with an array of cavities 38 joined thereto. Each cavity of the array of cavities 38 may be configured to hold and manipulate an article 10. The term "joined to" as used throughout this disclosure, encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The drum 43 may be configured to rotate about an axis 68. The drum 43 may rotate at a constant velocity, or the velocity of rotation may be varied, if desired. The rotation of the drum 43 may be continuous, or if desired, intermittent. The rotation of the drum 43 results in the cavities 42 joined thereto also rotating about the axis 68. There may be any number of cavities joined to the transfer device 48. There may be an even number of cavities or an odd number of cavities. The cavities may be positioned such that a first cavity of the array of cavities and a second cavity of the array of cavities abut. The cavities may be positioned such that a first cavity of the array of cavities and the second cavity of the array of cavities are positioned adjacent to one another. It is also to be appreciated that the cavities may have a constantly changing positional relationship with one another, such as with cavities that are disposed on a transfer device including individual programmable pucks. The cavities may be in any configuration that allows the articles to be decorated, such as a substantially linear configuration. The cavities 42 may be configured to hold articles having a variety of configurations, or they may be configured to more precisely correspond to the shape of the portion of the articles 10 that faces away from the transfer component 24.

Figure 6B:
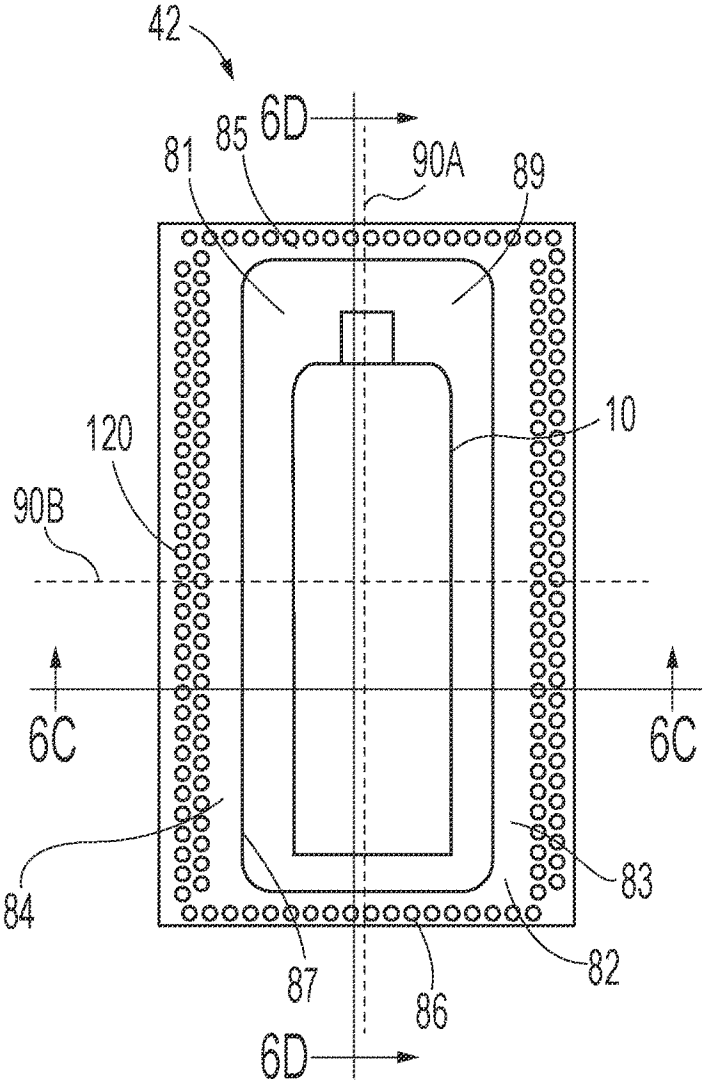
FIG. 6B is a front view of a cavity including an article.
Figure 6A:
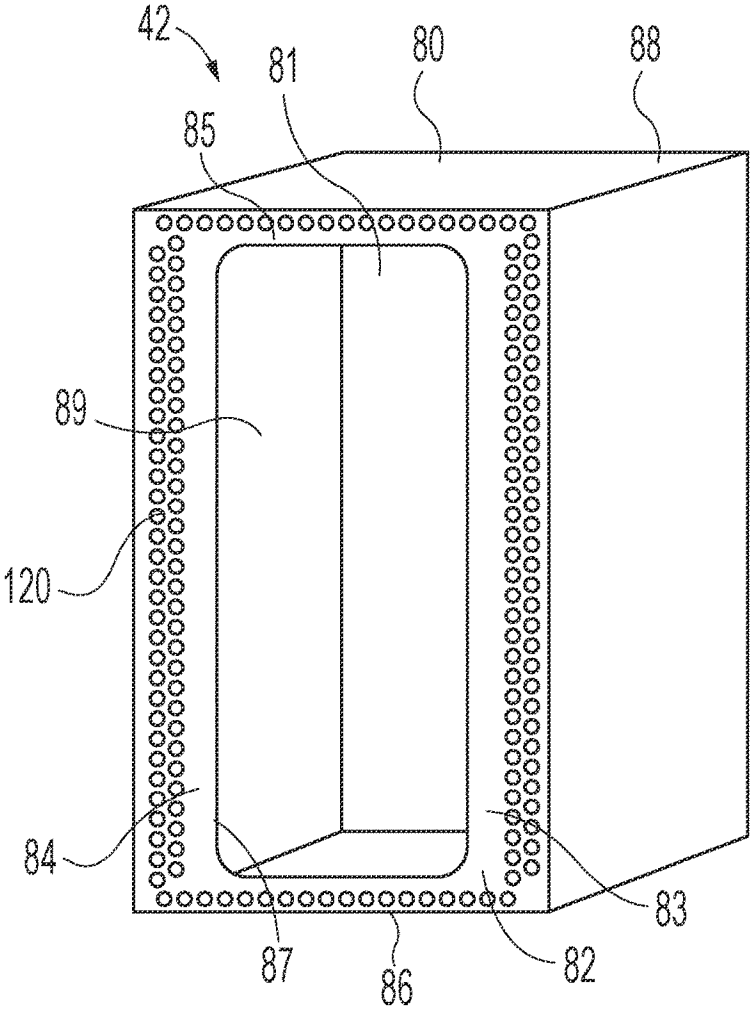
FIG. 6A is a perspective view of a cavity.

With reference to FIGS. 6A and 6B, each cavity 42 may be configured to receive, position, hold, traverse, and release the article 10. The cavity 42 may include a frame 80. The frame 80 may include a front face 82 and a back face 81 opposite the front face 82. The front face 82 may include a first side portion 83 and a second side portion 84, which may be opposite the first side portion 83. The front face 82 may also include an upper portion 85 and a lower portion 86 that may be opposite to the upper portion 85. The first side portion 83, the second side portion 84, the upper portion 85 and the lower portion 86 define an opening 87. It is to be appreciated that the front face 82 of the frame 80 may be a single unitary element or two or more elements joined to form the front face 82. The surface of the front face 82 of the frame 80 may be curved such that the array of cavities generally concentric to the rotational axis. The surface of the front face 82 may be substantially planar or any other shape that allows the array of cavities to traverse in a generally continuous process and/or allows the transfer material to be sealed thereto. The frame 80 includes a longitudinal frame axis 90A and a transverse frame axis 90B. The longitudinal frame axis 90A is substantially perpendicular to the transverse frame axis 90B.

The front face 82 may include a sealing portion 120. The sealing portion 120 may be any portion that controls the movement of the transfer component. The sealing portion 120 may or may not form an air-tight seal between the transfer component and the cavity. Sealing includes hermetically sealing and non-hermetically sealing. Sealing includes completely sealing and partially sealing. The sealing portion 120 may be any feature that is added to the front face to aid in controlling the position and movement of the transfer component. As discussed, to transfer the transfer material 22 to the article 10, the portion of the transfer component 24 including the transfer material 22 is positioned within the opening 87 of the cavity 42. The position of the transfer material 22 within the opening 87 should be such that the transfer material 22 is transferred to the target face of the article 10. To obtain and maintain the position of the transfer material 22 with respect to the article 10, a portion of the transfer component 24 may engage and be sealed to at least a portion of the first face 82 of the cavity 42. Sealing a portion of the transfer component 24 to at least a portion of the first face 82 of the cavity 42, isolates that portion of the transfer component 24 from downstream and upstream areas of the transfer component, and, thus, does not adversely affect the intended downstream and/or upstream use of the transfer component. Sealing a portion of the transfer component 24 to at least a portion of the first face 82 of the cavity 42, isolates that portion of the transfer component 24 that includes the transfer material, and ensures the position of the portion of the transfer component with the transfer material thereon as the transfer component and/or the article contact one another and the transfer material is transferred to the article. A registration system and/or control of the speed of the transfer component and/or the cavity may be used to position the transfer component 24 with respect to the article 10.

As illustrated in FIGS. 6A and 6B, the sealing portion 120 may include one or more apertures 121 and/or one or more grooves fluidly connected to a vacuum source. The one or more apertures 121 and/or grooves engage and seal a portion of the transfer component 24 to at least a portion of the front face 82 of the cavity 42. The sealing portion 120 may extend about the entire perimeter of the front face 82 or a portion thereof. For example, the one or more apertures 121 illustrated in FIG. 6 extend about the perimeter of the front face 82 of the cavity 42. The apertures and/or grooves may be positioned on any portion of the front face 82 such that a seal of the transfer component may be formed. Any other shape of sealing portion that allows for control of the transfer component may also be used. The sealing portion 120 may include one or more magnets, a static electricity device, an adhesive, or other mechanical device, such as clamps, to control the transfer component with respect to the cavity. Further, the front face 82 may include a surface feature to aid in controlling the transfer component. For example, the front face 82 may include a surface feature, such as texture or a coating, to increase the surface friction, to aid in controlling, such as by maintaining the position of, the transfer component 24.

The frame 80 may include a frame body 88. The frame body 88 may extend from the back face 81 and define a chamber 89 therein. The chamber 89 defined, at least in part, by the frame body 88 may be accessed through the opening 87 in the front face 82 of the frame 80. The frame body 88 may be any shape such that the cavity may receive, hold, and position the article.

Figure 6C:
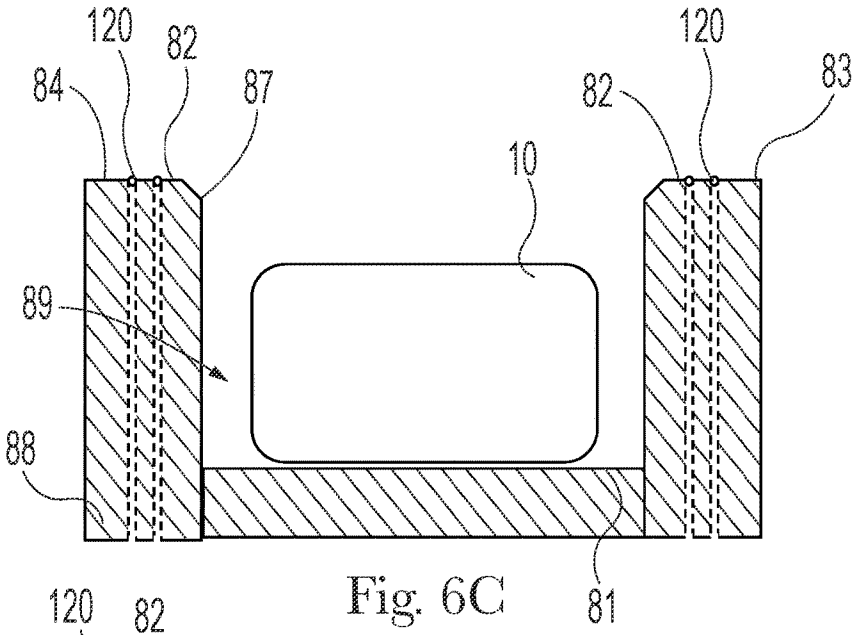
FIG. 6C is a cross-sectional view of the cavity including an article taken about line 6C-6C of FIG. 6B.
Figure 6D:
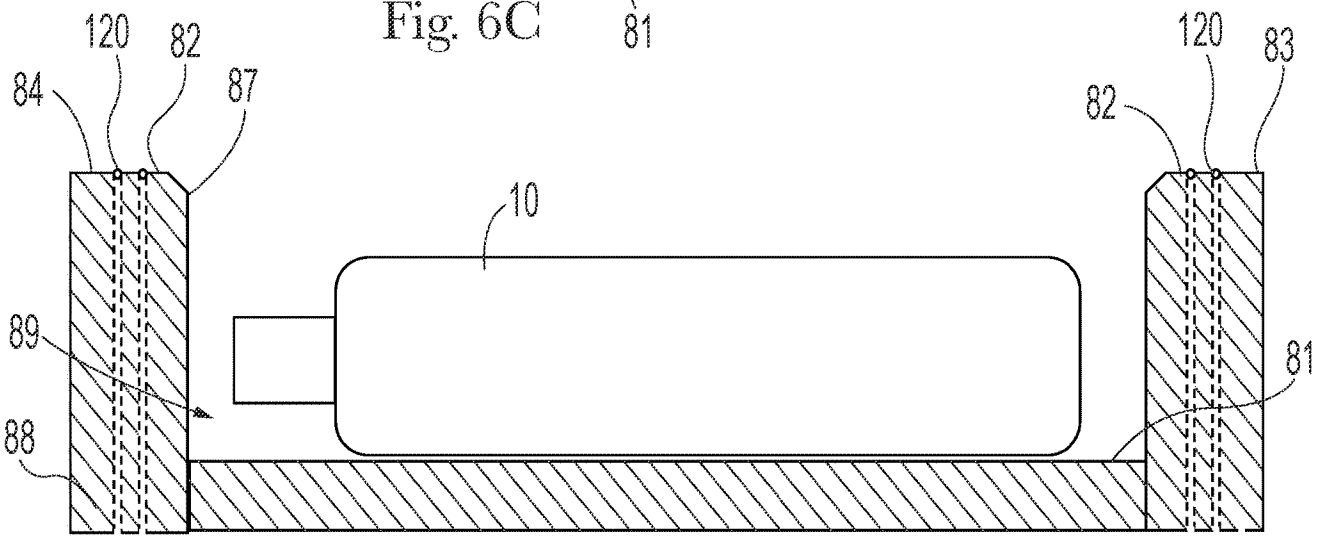
FIG. 6D is a cross-sectional view of the cavity including an article taken about line 6D-6D of FIG. 6B.

An article 10 may be positioned within the cavity 42, such as illustrated in FIG. 6B. The article 10 may be positioned within the cavity 42 such that any face and/or surface of the article may be supported by a portion of the frame body 88. The portion of the frame body 88 that supports the article 10 may depend in part on the orientation of the cavity 42. For example, for a cavity 42 orientated such that the longitudinal frame axis 90A and the transverse frame axis 90B are substantially parallel to a horizontal surface, the article 10 may be supported by the back face 81 of the frame body 88, such as illustrated in FIGS. 6C and 6D. It is to be appreciated that the article may not be supported by the frame body and may be supported by a support member and/or clamp, as discussed herein.

Figure 7A:
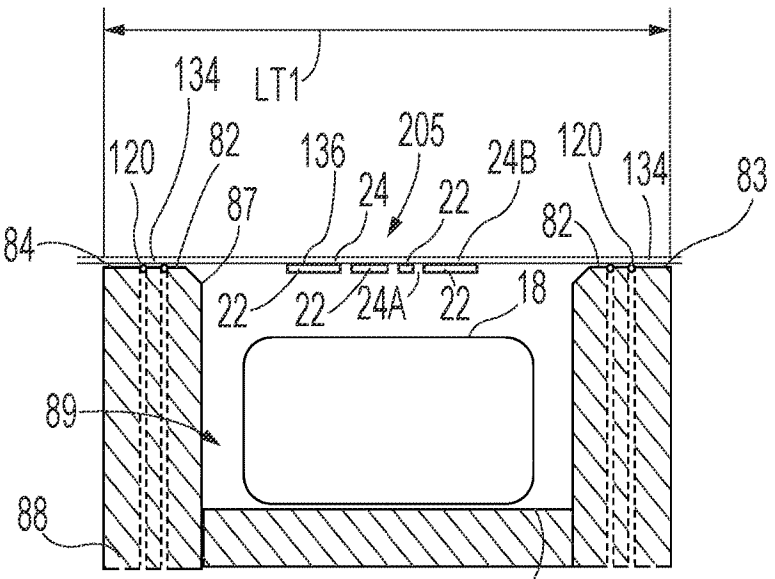
FIG. 7A is a side, partially cut-away view of a cavity including an article and a transfer component.
Figure 7B:
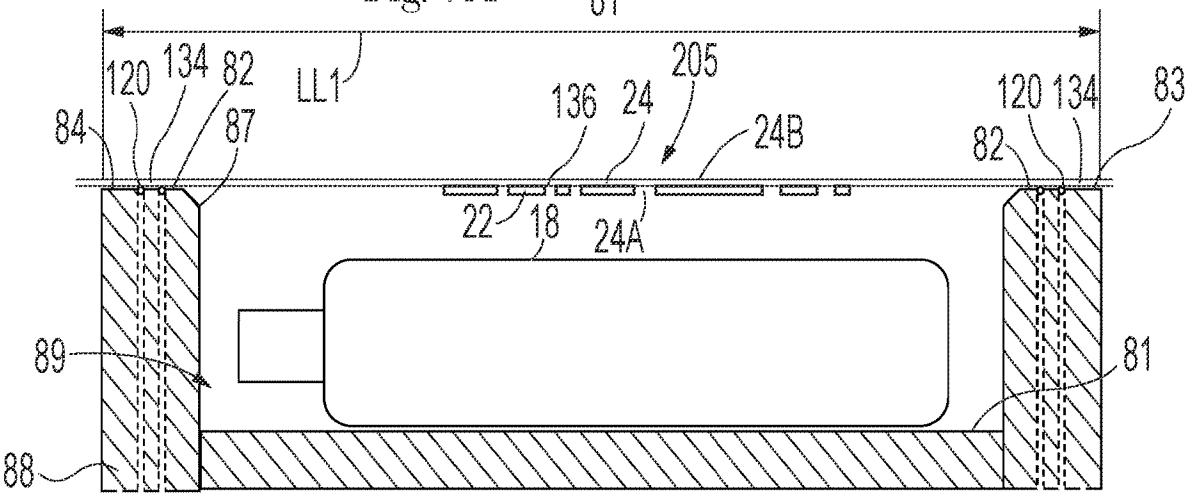
FIG. 7B is a side, partially cut-away view of a cavity including an article and a transfer component.

Referring to FIGS. 7A and 7B, the transfer component 24 may be disposed on the cavity 42. The transfer component 24 may include transfer material 22 disposed thereon. The transfer component 24 may be positioned with respect to the cavity such that the transfer material 22 is positioned within the opening 87 of the cavity 42 and in facing relationship with the target surface 18 of the article 10. A supported portion 134 of the transfer component 24 may engage a sealing portion 120 to position and hold the transfer component such that the transfer material 22 is in position to be transferred to the target surface 18 of the article 10. An unsupported portion 136 of the transfer component may extend over the opening 87 of the cavity 42. For a continuous transfer component, the sealing portion 120 may allow for other upstream and downstream processes to occur while the supported portion is sealed to the sealing portion and the unsupported portion 136 extends over the opening 87 of the cavity and remains unaffected by the upstream and downstream processing. Similarly, for a discrete transfer component, the sealing portion 120 seals the supported portion 134 and isolates that unsupported portion 136 of the transfer component extending over the opening 87 of the cavity 42.

The transfer component 24 with the transfer material 22 thereon has initial dimensions and an initial configuration prior to the modifying step. The terms "modify" or "modifying", as used herein with respect to the transformation that the portion of the transfer component 24 with the transfer material 22 thereon undergoes may include at least one of: (1) changing the dimensions of the portion of the transfer component 24 with the transfer material 22 thereon by increasing the dimensions in at least one direction by stretching the same; (2) changing the dimensions of the portion of the transfer component 24 with the transfer material 22 thereon by reducing the dimensions in at least one direction such as by shrinking or contracting the same; or (3) at least temporarily deforming, deflecting, flexing, or bending a portion of the transfer component 24 with the transfer material 22 thereon to conform to the configuration of the surface 12 of the article 10. The portion of the transfer component 24 that undergoes modification may be an unsupported portion 136 positioned over the opening of the cavity.

The term "modify" may be further specified herein as either including or excluding substantial compression of the thickness of the transfer component 24 as the primary type of modification, or as an aspect of the modification. For example, compression greater than about 5% of the uncompressed thickness of the transfer component 24. It is to be appreciated that although the modification may, for example, be one of stretching to modify the transfer component 24 with the transfer material 22 thereon, the transfer itself may rely on some level of compressive force being applied in the direction of the thickness of the transfer component 24 to ensure good contact for the transfer of the transfer material 22 to the surface 12 of the article. The term "modify" may be further specified as excluding bending or wrapping the transfer component 24 about a cylindrical object. In such cases, the transfer component 24 may be said to be modified other than in the configuration of a portion of a cylindrical surface. That is, if bent, the transfer component 24 with the transfer material 22 thereon is bent such that it may have portions with different radii and/or axes of curvature.

In the various different types of processes described herein, there may be several aspects to transferring the transfer material 22 from the transfer component 24 to the surface of the article 10. As described above, a portion of the transfer component 24 with the transfer material 22 thereon, may be modified. These aspects include: contacting, conforming, and transferring. More specifically, the transfer operation may include contacting the article 10 with the transfer material 22. The transfer operation may include conforming the transfer material 22 to the configuration of the target face 18 of the article 10. The transfer operation may include a transfer of the transfer material 22 from the transfer component 24 to the target face 18 of the article 10. The order in which some of these aspects occur relative to each other may vary depending on the type of process used.

Modifying the transfer component 24 with the transfer material 22 thereon may occur at any of the following times: prior to contact between the article 10 and the transfer material 22; simultaneously with contacting; after contacting; or any combination thereof. The contact may occur in any of the following manners, by: moving, also referred to herein a traversing, the article 10 to make contact with the transfer component 24; moving the transfer component 24 to make contact with the article 10; or moving both the article 10 and the transfer component 24 to contact each other.

Conforming the transfer material 22 to the configuration of the target face 18 of the article 10 is typically associated with the aspect of modifying the transfer component 24 with the transfer material 22 thereon. The aspect of conforming the transfer material 22 to the configuration of the target face 18 of the article 10 may occur before the transfer material 22 is brought into contact with the surface 12 of the article 10, simultaneously with contacting, or after contacting, or any combination thereof.

Contacting the article 10 with the transfer material 22 may occur before there is a transfer of the transfer material 22 to the surface 12 of the article 10. Transferring the transfer material 22 from the transfer component 24 to the target face 18 of the article 10 may occur simultaneously, or after contacting the article 10 with the transfer material 22.

It may be desirable to ensure that the transfer material 22 conforms closely to the surface 12 of the articles 10. This will reduce the chance that there will be wrinkles in the transfer material 22 and/or that fluid, such as air, gets trapped or entrained between the target face 18 of the article and the transfer material 22. This will also reduce the chance that portions of the transfer material 22 will span, without contacting, between portions of the surface 12 which may have a depression or other complex curvature therein, rather than adhering closely to the surface of the article in those depressions. Also, if there is too large of a gap between the transfer material 22 and the article, then the transfer material 22 may not contact the surface 12 of the article 10 and possibly not transfer that portion of the transfer material 22 to the article 10.

The transfer component 24 may be optionally pre-stretched prior to and/or during the deposit of a material thereon. The transfer component 24 with the transfer material 22 thereon may be temporarily relaxed before conforming the same to the surface of an article 10. Following the relaxation, the transfer component 24 with the transfer material 22 thereon may then be modified, such as by stretching, to conform the same to the surface of an article 10. Applying the transfer material 22 to a pre-stretched transfer component 24 may reduce or eliminate any negative effects on the transfer material during the subsequent step of modifying (such as by stretching) the same when conforming the transfer component 24 with the transfer material 22 thereon to the target face 18 of an article 10. The negative effects may include, but are not limited to, damage to any image on the transfer material, and/or reduction in the quality of the image.

As previously discussed, the transfer component 24 may be in the form of a continuous or discontinuous web having portions that may be controlled by one or more sealing portions 120. A supported portion of the transfer component 24 may be supported by the cavity 42 and an unsupported portion of the transfer component 24 may extend over the opening 87 of the cavity 42. The transfer component 24 may contact the article 10 in order to conform the transfer component 24 with the transfer material 22 thereon to the target face 18 of the article 10. The sealing portion 120 may be any suitable type of component that is capable of maintaining the position of a portion of the transfer component 24. The sealing portion 120 may ensure that any stretching of the portion of the transfer component 24 during the conforming is isolated so that adjacent portions of the transfer component 24 are not stretched and/or the transfer component 24 does not move out of the desired position during the conforming. The transfer component 24 may be brought into position, such as previously discussed, in proximity with a portion of the article 10. The modified portion of the transfer component 24 is the unsupported portion 136 that spans the opening 87 of the cavity 42. A device may be used to push or pull this unsupported portion 136 of the transfer component in order to conform the transfer component 24 with the transfer material 22 thereon to the target face 18 of the article 10.

With reference to FIGS. 7A, 7B, 8A, and 8B, the unsupported portion 136 of the transfer component 24 with the transfer material 22 thereon that is isolated by the sealing portion and extends over the opening may have a first transverse length LT1 measured along its surface 24A in a direction substantially parallel to the transverse axis 90B and a first longitudinal length LL1 measured along its surface in a direction substantially parallel to the longitudinal axis 90A before it contacts and conforms to the desired portion of the surface 12 of an article 10. The transfer component 24 with the transfer material 22 thereon may have a second transverse length LT2 measured along the surface of the transfer component in a direction substantially parallel to the transverse axis 90B and a second longitudinal length LL2 measured along the surface of the transfer component in a direction substantially parallel to the longitudinal axis 90A after the transfer component is modified. It is to be appreciated that the lengths are measured following along the surface 24A of the transfer component 24, rather than the distance between two points (the dimension lines in the figures are shown merely for ease of illustration). The second lengths LT2, LL2 may be greater than the first lengths LT1, LL1 when the transfer component 24 with the transfer material 22 thereon is modified and conforms to the surface curvature of an article, such as a three-dimensional article. The transfer material 22 may undergo a similar change in length as that of the transfer component 24. The transfer material 22 may undergo a similar strain as that of the transfer component 24. The extensibility of the transfer component 24 allows the change in lengths.

If the adhesive 52 or, the ink component having adhesive properties is of a type that requires curing to fully adhere to the to the target face 18 of the article 10, the adhesive or ink component may be cured by an energy source 50 positioned adjacent to the cavity 42. The energy source 50 adheres the transfer material 22 to the target face 18 of the article 10. Curing may be done after the article 10 is brought into contact with the transfer material 22 on the transfer component 24.

Figure 8A:
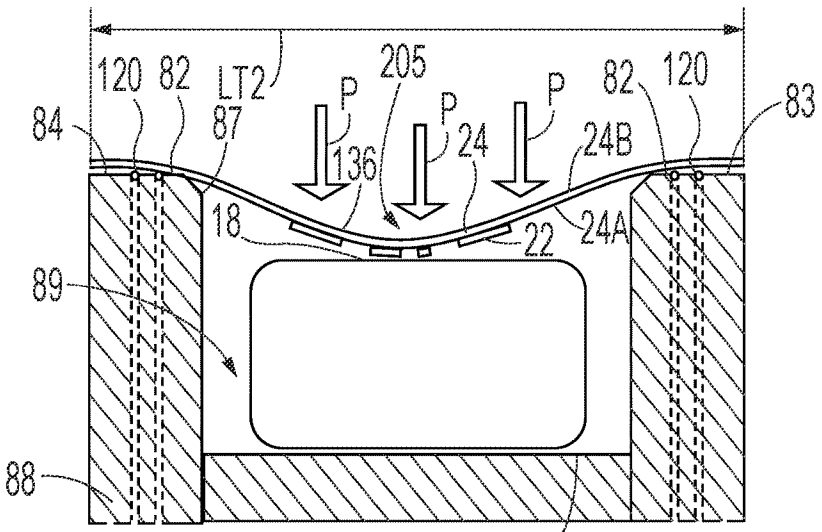
FIG. 8A is a side, partially cut-away view of a cavity including an article and a transfer component.

Having the transfer component 24 with the transfer material 22 thereon conform to the target surface 18 of the article 10 is important to achieve transfer of the transfer material 22 to the article and to obtain the desired decorated face of the article 10. Thus, additional forces may act on the transfer component 24 or, more specifically, the portion of the transfer component 24 with the transfer material 22 thereon. A force may be applied to the back surface 24B and/or the transfer surface 24A of the transfer component 24. For example, air pressure/vacuum may be used for bringing the transfer component 24 with the transfer material 22 thereon into closer contact with the surface 12 of the article 10. More specifically, the transfer component 24 with the transfer material 22 thereon may be brought into closer contact with the surface 12 of the article 10 by exerting a pushing force on the back surface 24B of the transfer component 24 using air pressure, P, such as illustrated in FIG. 8A.

Figure 8B:
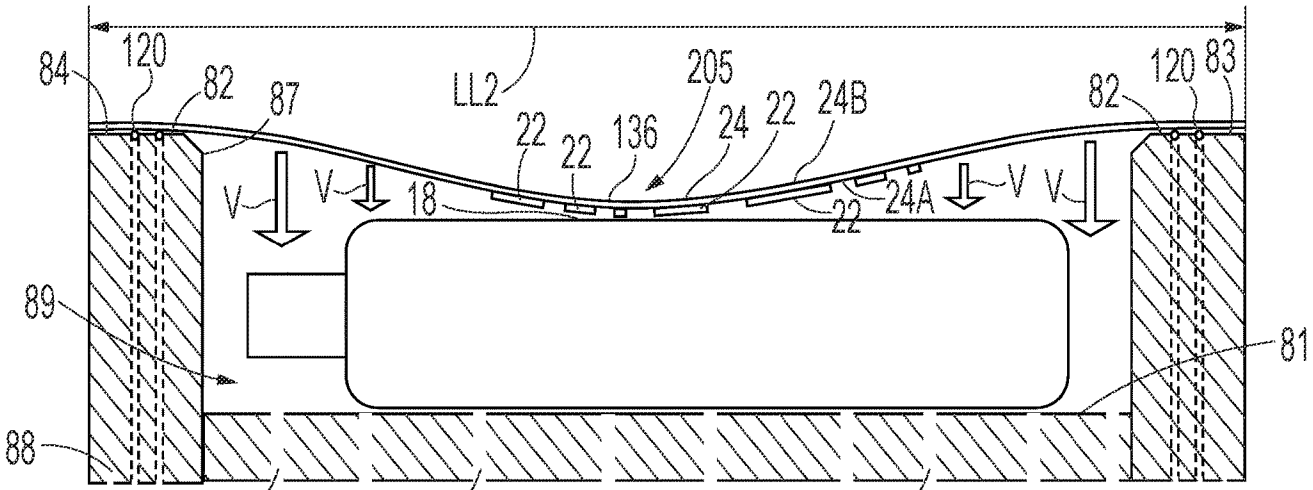
FIG. 8B is a side, partially cut-away view of a cavity including an article and a transfer component.

FIG. 8B illustrates a force for bringing the transfer component 24 with the transfer material 22 thereon toward the article 10 and/or into contact with one or more surfaces of the article 10. The force results from lowering the pressure within the cavity as compared to the pressure outside the cavity, also referred to herein as creating a pressure differential. As previously discussed, a cavity 24 including a sealing portion 120 may provide a substantially fluid tight seal around the portion of the transfer component 24. Thus, the portion of the transfer component 24 disposed over the opening 87 of the cavity may be isolated from the surrounding portions of the transfer component 24. A vacuum, V, may be drawn through conduits 104 defined by a portion of the cavity 42 and in fluid communication with a vacuum source. The vacuum V lowers the pressure within the cavity, as compared to the pressure outside the cavity, resulting in the force on the transfer component 24. The force on the transfer component 24 may cause modification of the transfer component, which may include, but is not limited to, moving, stretching, and conforming of the transfer component 24 with the transfer material 22 thereon to one or more surfaces 12 of the article 10.

It is to be appreciated that a pulling force and a pushing force may be used in combination to aid in conforming the transfer component to the article. This may be achieved by other components such as described in U.S. Patent Publication Nos. 2017/0182756 and 2017/0182704.

It is to be appreciated that although the description describes positioning a face to be decorated, the entire face need not be decorated and only a portion of the face, such as one or more surface of the face, may be decorated.

Figure 9B:
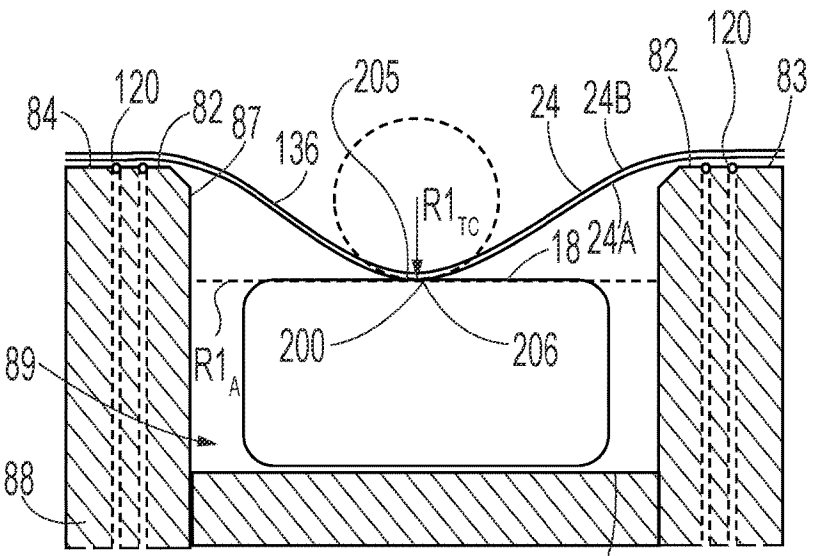
FIG. 9B is a cross-sectional view of the cavity including an article and a transfer component taken about line 9B-9B of FIG. 9A.
Figure 9A:
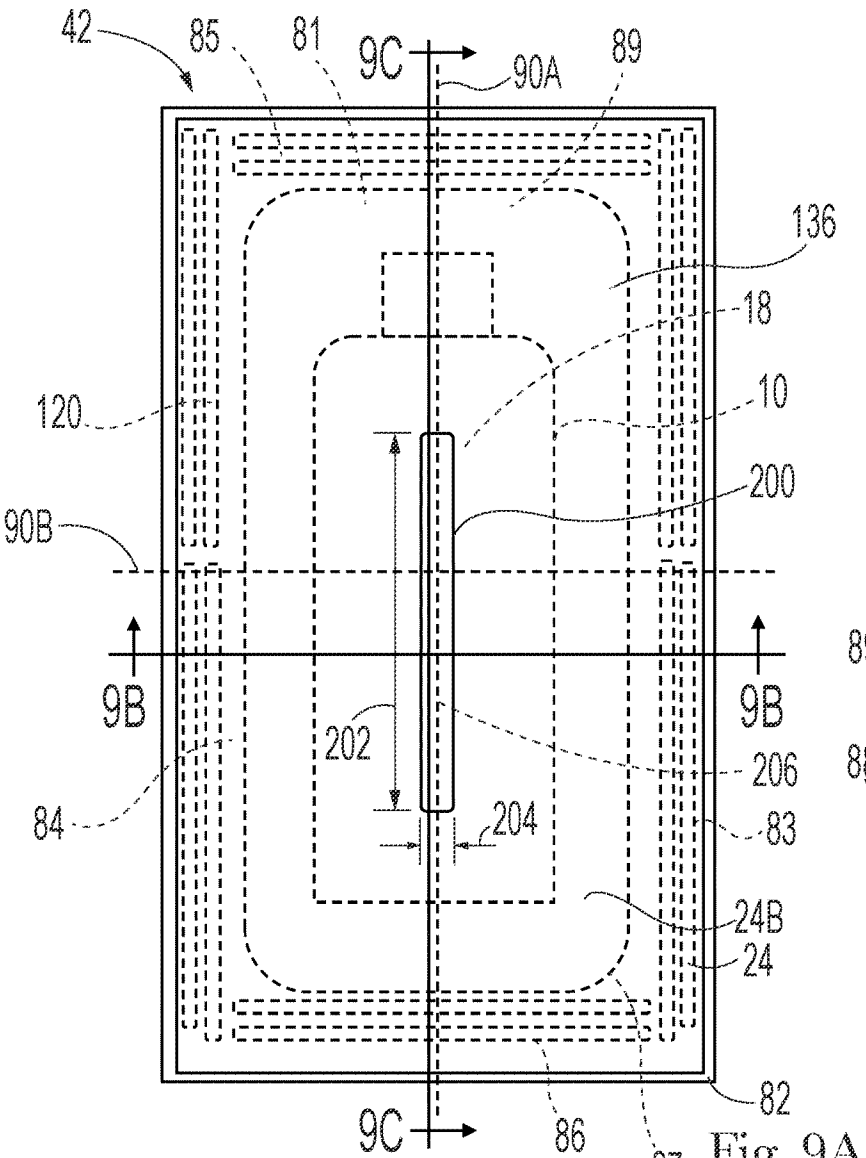
FIG. 9A is a top view of a cavity including an article and a transfer component.
Figure 9C:
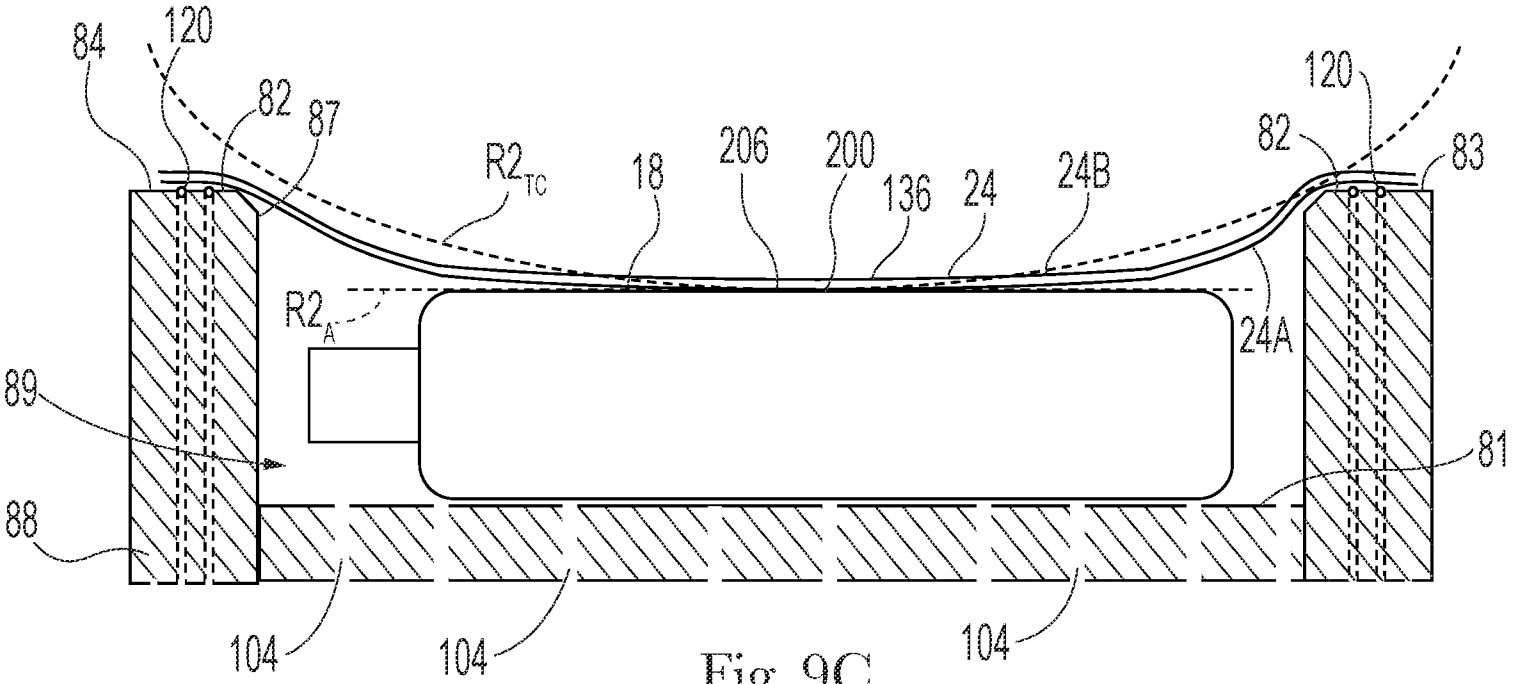
FIG. 9C is a cross-sectional view of the cavity including an article and a transfer component taken about line 9C-9C of FIG. 9A.

Trapped fluid between the transfer component 24 and the article 10 may result in defects such as wrinkles and insufficiently adhered transfer material. These defects are relatively unacceptable to consumers and need to be minimized or eliminated in the process of transferring that transfer material from the transfer component to the article. One way to avoid or minimize these defects is to control the modification of the transfer component during the transfer process. With reference to FIGS. 9A, 9B, and 9C, when modifying the unsupported portion 136 of the transfer component 24 with the transfer material thereon, the unsupported portion 136 may be modified in view of the one or more faces or one or more surfaces of the article that are to be decorated. To prevent or minimize the amount of fluid, such as air, trapped between the transfer component and the article and wrinkles in the transfer material, the unsupported portion 136 of the transfer component 24 may be modified to control the initial contact area 200 between the article 10 and the unsupported portion 136 of the transfer component 24.

The initial contact area 200 is the area covered by the transfer component when the transfer component makes initial contact with the article 10. Stated another way, the initial contact area 200 is the area of contact between the article and the transfer component upon initial contact between the article and transfer component. The initial contact area 200 may have an initial contact first dimension 202 and an initial contact second dimension 204. The initial contact first dimension 202 may be different than the initial contact second dimension 204. The initial contact first dimension 202 may be at least two times greater than the initial contact second dimension 204. The first dimension 202 of the initial contact area 200 may be measured substantially parallel to the longitudinal frame axis. The first dimension 202 of the initial contact area may correspond to an initial contact area height. The second dimension 204 of the initial contact area 200 may be measured substantially parallel to the transverse frame axis. The second dimension 204 of the initial contact area 200 may correspond to an initial contact area width. At least one of the initial contact area first dimension 202 and the initial contact area second dimension 204 may be less than about 0.5 mm or less than about 1 mm or less than about 3 mm or less than about 6 mm or less than about 9 mm or less than about 10 mm or less than about 15, which will minimize or avoid trapped fluid and prevent or minimize wrinkles in the transfer material. By minimizing at least one of the initial contact area first dimension and the initial contact area second dimension, there is less opportunity for fluid, such as air, to become trapped between the transfer component and the article and for wrinkles to form. Stated another way, by minimizing the initial contact area, there is less area under which fluid, such as air, may get trapped as the transfer component initially contacts the article.

To control the initial contact area 200, the geometry of the article and the geometry of the modified transfer component should be considered. The article may be disposed within the cavity. A face and/or one or more surfaces of the article may be positioned in facing relationship with the transfer component, which may include a corner, a shoulder, a groove, or other geometrical feature of the article. The article may be positioned within the cavity such that an intermediate portion of the face is substantially centered within the cavity and a first face portion is positioned between the intermediate portion and the frame and a second face portion is positioned between the intermediate portion and the frame. The article may be placed in the cavity 24 such that an article predetermined contact area 206, which may include a face and/or one more surfaces of the article, will be contacted initially by the transfer component. The article predetermined contact area 206 may be selected to minimize or avoid trapped fluid. For example, a relatively flat, front face of the article may be selected or a portion of the face that includes a projection may be selected. The article predetermined contact area 206 may be determined, in part, due to the placement of the article 10 within the cavity and the placement and modification of the unsupported portion of the transfer component. The article predetermined contact area 206 includes one or more radii of curvature of the surface of the article It is to be appreciated that the article predetermined contact area 206 may coincide with the entire initial contact area 200 or a portion thereof.

The article predetermined contact area 206 has an article contact area first radius of curvature $R1_A$ measured along the surface of the article and in a first direction, and an article contact area second radius of curvature $R2_A$ measured along the surface of the article in a direction substantially perpendicular to the first direction. The first direction may be substantially parallel to the longitudinal axis or the transverse axis. For example, the article contact area first radius of curvature $R1_A$ may be measured along the surface in a direction substantially parallel to the transverse axis and the article contact area second radius of curvature $R2_A$ may be measured along the article surface in a direction substantially parallel to the longitudinal axis, such as illustrated in FIGS. 9B and 9C, or the article contact area first radius of curvature $R1_A$ may be measured along the article surface in a direction substantially parallel to the longitudinal axis and the article contact area second radius of curvature $R2_A$ may be measured along the article surface in a direction substantially parallel to the transverse axis. The article contact area first radius of curvature $R1_A$ may be the same as or different then the article contact area second radius of curvature $R2_A$. The article contact area first radius of curvature $R1_A$ and the article contact area second radius of curvature $R2_A$ include any radius of curvature. For example, the article contact area first radius of curvature $R1_A$ and the article contact area second radius of curvature $R2_A$ may each be infinite radii of curvature, which is a substantially flat surface, such as illustrated in FIGS. 9B and 9C.

The initial contact area 200 is also affected by the transfer component. The transfer component may be disposed on the cavity such that an unsupported portion of the transfer component is suspended over the opening of the cavity. The unsupported portion of the transfer component may be modified. The radii of curvature of the unsupported portion of the transfer component changes as the unsupported portion is modified. For example, the unsupported portion of the transfer component may be substantially flat prior to being modified. As the unsupported portion of the transfer component is modified, the unsupported portion of the transfer component may be drawn toward the article. The unsupported portion may develop a curvature extending in a direction substantially parallel to the transverse axis and a curvature extending in a direction substantially parallel to the longitudinal axis. These curvatures may become more prominent as the unsupported portion continues to be drawn toward the article. Just prior to contacting the article, the portion of the transfer component that will initially contact the article, the unsupported portion predetermined contact area 205, includes a transfer component first radius of curvature $R1_{TC}$ and a transfer component second radius of curvature $R2_{TC}$.

The unsupported portion predetermined contact area 205 is the area of the unsupported portion of the transfer component that is intended to initially contact the article. The unsupported portion predetermined contact area 205 may include transfer material or a portion of the transfer material that is intended for certain area of the article, such as the article predetermined contact area 206. The unsupported portion of the transfer component may be modified to ensure that the unsupported portion predetermined contact area 205 or a portion thereof is the area of the unsupported portion that is initially contacted by the article. The unsupported portion predetermined contact area 205 may be selected to minimize or avoid trapped fluid. The unsupported portion predetermined contact area 205 may be determined, in part, due to the placement of the article 10 within the cavity and the placement and modification of the unsupported portion of the transfer component. The unsupported portion predetermined contact area 205 includes one or more radii of curvature of the surface of the unsupported portion just prior to contacting the article. It is to be appreciated that the unsupported portion predetermined contact area 205 may coincide with the entire initial contact area 200 or a portion thereof. It is to be appreciated that the unsupported portion predetermined contact area 205 need not be in the central portion of the unsupported portion of the transfer component. The unsupported portion predetermined contact area 205 may be any portion of the unsupported portion that is to initially contact the article.

The unsupported portion 136 of the transfer component may be modified such that the unsupported portion predetermined contact area 205 has a transfer component first radius of curvature $R1_{TC}$ and a transfer component second radius of curvature $R2_{TC}$, such as illustrated in FIGS. 9B and 9C, just prior to contacting the article. The transfer component first radius of curvature $R1_{TC}$ may be measured along the surface of the unsupported portion of the transfer component and in a first direction, and the transfer component second radius of curvature $R2_{TC}$ may be measured along the surface of the transfer component in a direction substantially perpendicular to the first direction. The first direction may be substantially parallel to the longitudinal axis or the transverse axis. For example, the transfer component first radius of curvature $R1_{TC}$ may be measured along the transfer component surface in a direction substantially parallel to the transverse axis and the transfer component second radius of curvature $R2_{TC}$ may be measured along the transfer component surface in a direction substantially parallel to the longitudinal axis, such as illustrated in FIGS. 9B and 9C, or the transfer component first radius of curvature $R1_{TC}$ may be measured along the transfer component surface in a direction substantially parallel to the longitudinal axis and the transfer component second radius of curvature $R2_{TC}$ may be measured along the transfer component surface in a direction substantially parallel to the transverse axis. The transfer component first radius of curvature $R1_{TC}$ may be the same as or different then the transfer component second radius of curvature $R2_{TC}$. The transfer component first radius of curvature $R1_{TC}$ and the transfer component second radius of curvature $R2_{TC}$ include any radius of curvature.

The transfer component first radius of curvature and the transfer component second radius of curvature may be due in part to how the supported portion is sealed to the cavity, the geometry, both internal and external, of the cavity, and how the transfer material is modified, such as by vacuum and/or other external pressure. Regardless, to minimize or avoid fluid becoming trapped between the transfer component and the article and minimize or eliminate wrinkles, for the transfer component radius of curvature extending substantially parallel to the article contact area radius of curvature, the transfer component radius of curvature and the article contact area radius of curvature should be different.

As illustrated in FIG. 9B, the transfer component has a first radius of curvature $R1_{TC}$ that is measured along the surface of the transfer component in the area of the transfer component just prior to contacting the article. The transfer component first radius of curvature $R1_{TC}$ is measured along the surface of the transfer component in a direction parallel to the transverse axis. The article includes a contact area first radius of curvature $R1_A$. The contact area first radius of curvature is measured along the surface of the article in a direction substantially parallel to the transverse axis. As illustrated in FIG. 9B, the transfer component first radius of curvature $R1_{TC}$ is less than the contact area first radius of curvature $R1_A$. The transfer component first radius of curvature $R1_{TC}$ being different relative to the radius of curvature of the article eliminates or minimizes the amount of fluid that may become trapped between the transfer component and the article.

As illustrated in FIG. 9C, the transfer component has a second radius of curvature $R2_{TC}$ that is measured along the surface of the transfer component in the area of the transfer component that is to be initially disposed on the article, just prior to contacting. The transfer component second radius of curvature $R2_{TC}$ is measured along the surface of the transfer component in a direction parallel to the longitudinal axis. The article includes a contact area second radius of curvature $R2_A$. The contact area second radius of curvature is measured along the surface of the article in a direction substantially parallel to the longitudinal axis. As illustrated in FIG. 9C, the transfer component second radius of curvature $R2_{TC}$ is less than the contact area second radius of curvature $R2_A$. The transfer component second radius of curvature $R2_{TC}$ minimizes the initial contact area 200 between the article and the transfer component which eliminates or minimizes the amount of fluid that may become trapped between the transfer component and the article.

The fluid that may become trapped between the transfer component and the article in the initial contact area 200 may be minimized, as previously discussed, by controlling the radius of curvature of the transfer component with respect to the radius of curvature of the article. Upon contacting the transfer component and the article in the initial contact area 200, the remainder of the transfer component needs to contact the remainder of the face and/or surfaces of the article such that that transfer material may be disposed on the article and transferred from the transfer component to the face and/or surfaces of the article. To minimize or eliminate wrinkles and the fluid that may become trapped between the transfer component and the article during the remainder of the transfer process, the manner in which the transfer component continues to contact the article may be controlled.

Figure 10B:
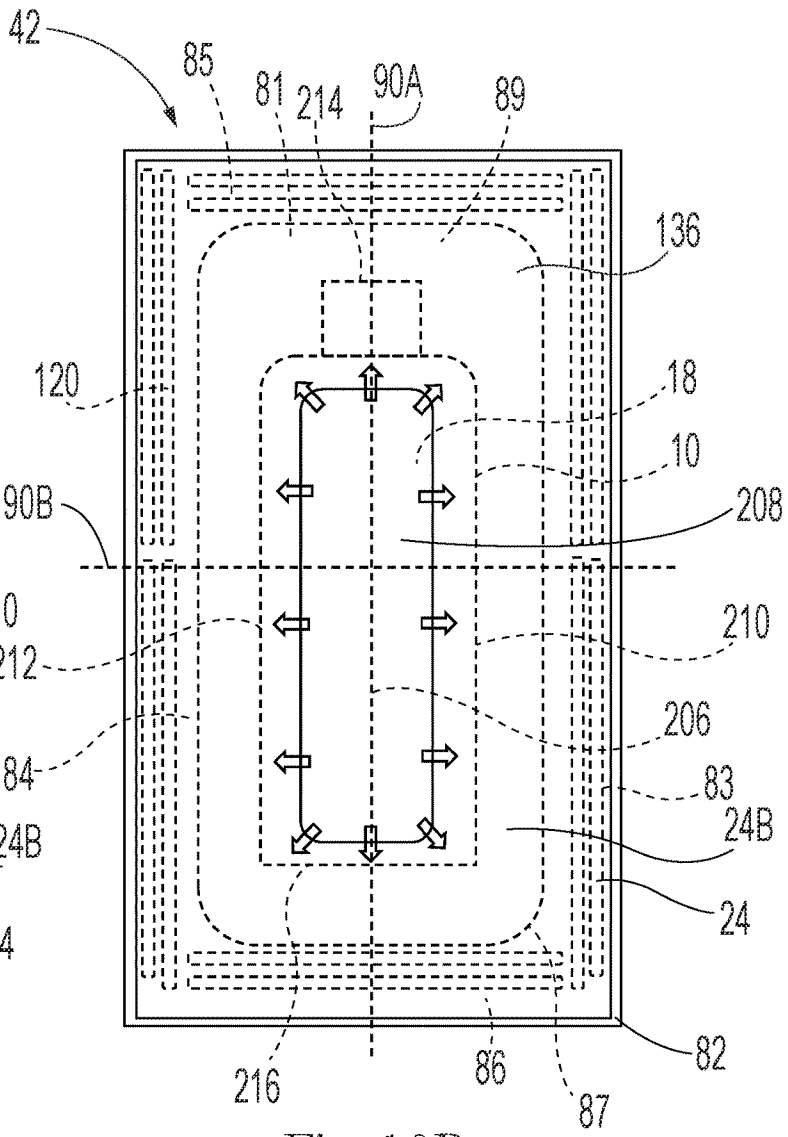
FIG. 10B is a top view of a cavity including an article and a transfer component.
Figure 10A:
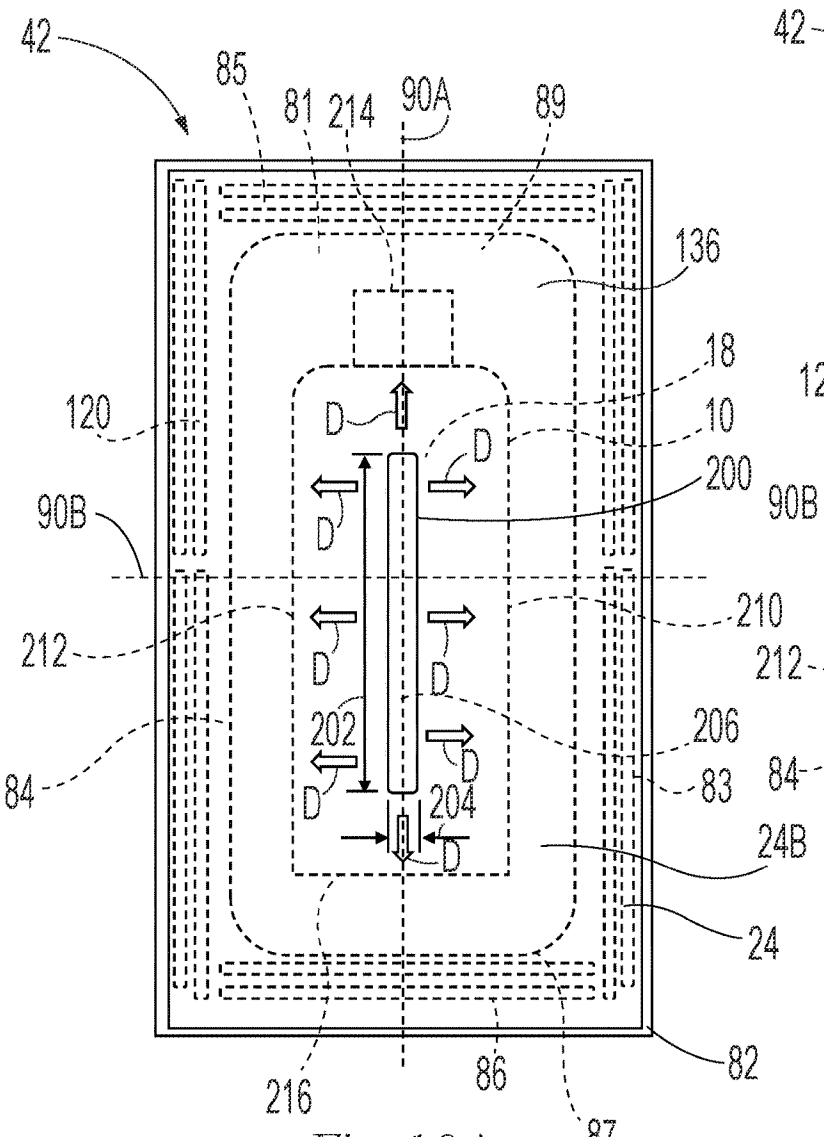
FIG. 10A is a top view of a cavity including an article and a transfer component.

As illustrated in FIGS. 10A and 10B, the transfer component initially contacts the article in the initial contact area 200. The transfer component may be controlled by an internal or external force, such as an internal vacuum force or an external pressure force, such that the transfer component gradually continues to contact the article by being swept in a direction D, indicated by arrow D, from the initial contact area 200 toward one or more edge portions of the face, or target face 18. The area of initial contact area 200 may increase into a contact area 208, the area of which continues to increase as the transfer component continues to contact the face and/or surfaces of the target surface 18. The transfer component may continue to contact the face of the article in a direction extending radially outward from the initial contact area 200 or in one or more directions extending outward from the initial contact area 200.

More specifically, upon initially contacting the article in the initial contact area 200, the transfer component continues to contact the article. The sweeping contact of the transfer component moves from the initial contact area 200 toward, for example, a first edge portion 210 of the face 18 and a second edge portion 212 of the face 18. The first edge portion 210 may be the portion of the article positioned between the contact area and the frame and the second edge portion 212 may be a portion of the article positioned between the contact area and the frame. Further, the transfer component moves from the initial contact area 200 toward, for example, a third edge portion 214 of the face 18 and a fourth edge portion 216 of the face 18. Stated another way, the unsupported portion of the transfer component may continue to contact the surface of the face of the article in a sweeping direction such that the unsupported portion of the transfer component moves in a direction perpendicular to the initial contact area first dimension toward at least one of the first edge portion 210 and the second edge portion 212 and in a direction perpendicular to the initial contact area second dimension toward at least one of the third edge portion 214 and the fourth edge portion 216. The controlled gradual contact between the unsupported portion of the transfer component and the article allows fluid, such as air, to be squeezed out from between the transfer component and the article as the unsupported portion contacts the face of the article. The contact area 208 continues to increase until the area of the transfer component with the transfer material thereon is in contact with the article.

To control the how the unsupported portion of the transfer component initially contacts and continues to contact the article, differing forces may be applied to the unsupported portion of the transfer component. For example, as the unsupported portion of the transfer component is modified from its initial state of being disposed on the frame to a second state of forming initial contact in an initial contact area with the article, a first pressure differential may be applied to the unsupported portion of the transfer component. This first pressure differential may be supplied by a source internal to or external to the cavity. The first pressure differential is such that the pressure within the cavity is different than the pressure outside the cavity which causes the unsupported portion of the transfer component to be modified. Once the unsupported portion of the transfer component has formed the initial contact area between the transfer component and the article, a second pressure differential may be applied to the unsupported portion of the transfer component. The second pressure differential may be supplied by a source internal to or external to the cavity. The second pressure differential is such that the pressure within the cavity is different than the pressure outside the cavity. The first pressure differential may be the same as or different than the second pressure differential. For example, the pressure differential may increase from the first pressure differential to the second pressure differential. It is to be appreciated that the first pressure differential and the second pressure differential may be a single, continuous pressure applied to the unsupported portion of the transfer component or a variable, such as increasing and/or decreasing, pressure applied to the unsupported portion of the transfer component. Examples of creating a pressure differential include applying a vacuum within the cavity and/or an external pressure, such as compressed air, outside the cavity.

The process of applying the unsupported portion of the transfer component to the face and/or surfaces of the article may be such that the process may be used on relatively high-speed manufacturing lines.

Figure 10C:
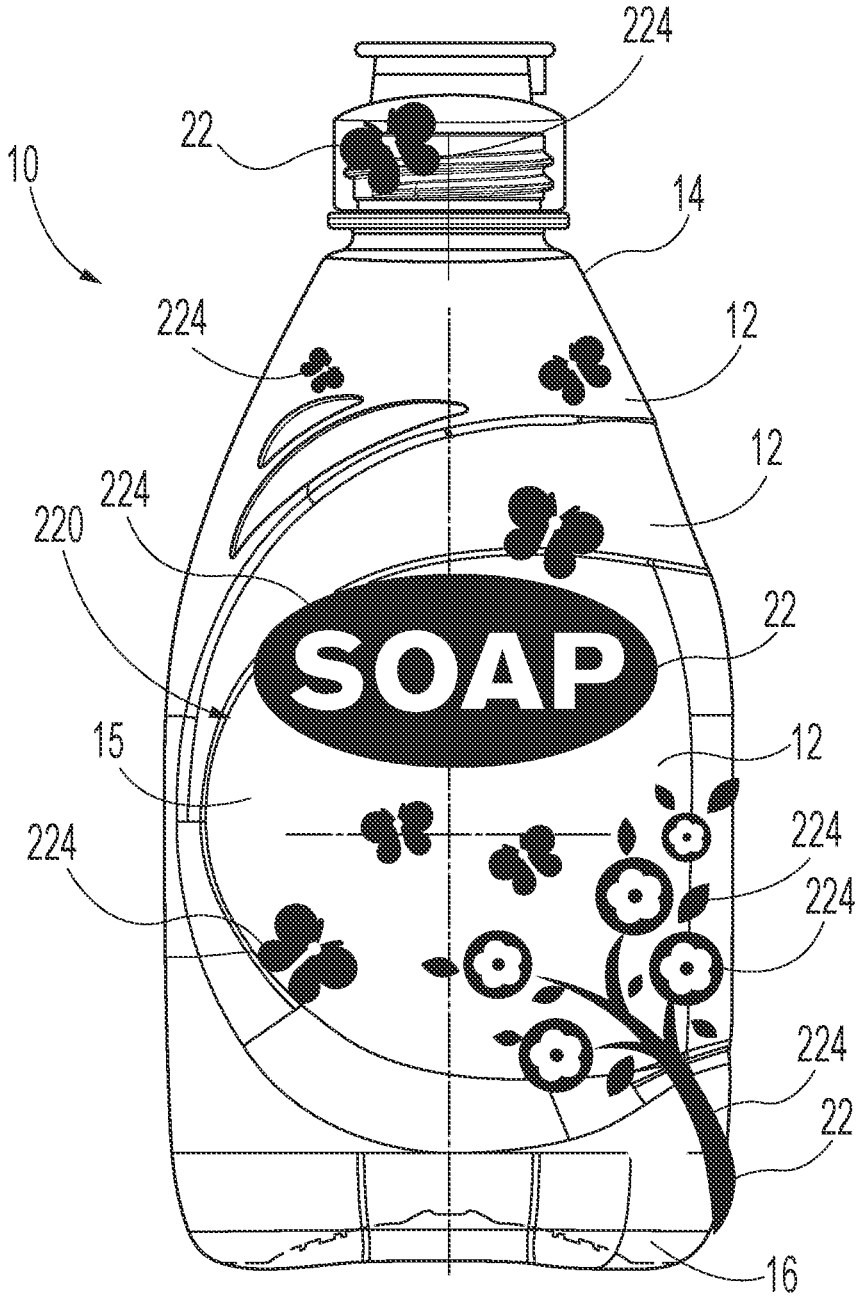
FIG. 10C is a side view of an article.

As previously discussed, the transfer material 22 may be transferred from the transfer component 24 to a face, including one or more surfaces 12, of the article 10. Once the transfer material 22 has been transferred to the face of the article 10, the unsupported portion 136 of the transfer component 24 may be removed from contacting the article 10. The face of the article 10 including the transfer material 22 may be referred to herein as a decorated portion. The article 10 including the decorated portion may be unloaded form the cavity or may be rotated to decorate a different portion of the article or the article may remain in the same position and a different portion of the article may be decorated by a different transfer component. As illustrated in FIG. 10C, the decorated article includes the transfer material 22. The transfer material 22 may be applied to the article 10 in a predetermined pattern 220, as previously discussed. The predetermined pattern may include one or more transfer materials. The predetermined pattern includes discrete portions 224 that together present an integrated or related pattern of one or more words, figures, images, or indicia. For example, as illustrated in FIG. 10C, each of the butterflies, leaves, tree, and flowers are discrete portions 224 that form a part of the predetermined pattern 220. Each of the discrete portions 224 of the predetermined pattern are made up of a transfer material, which includes one or more layers of materials, as discussed herein. The one or more layers of materials that make up the transfer material may all have substantially the same dimensions for a discrete portion. For example, a discrete portion may include a transfer material including an adhesive layer, an ink layer, and a varnish layer. For the discrete portion the adhesive layer, the ink layer, and the varnish layer may have substantially the same dimensions. As illustrated in FIG. 10C, each discrete portion 224 of the predetermined pattern 220 is joined to the same article 10, but those discrete portions may be otherwise unconnected from one another. It is to be appreciated that a single article may include one or more distinct predetermined patterns and each distinct predetermined pattern may include two or more discrete portions.

Figure 11A:
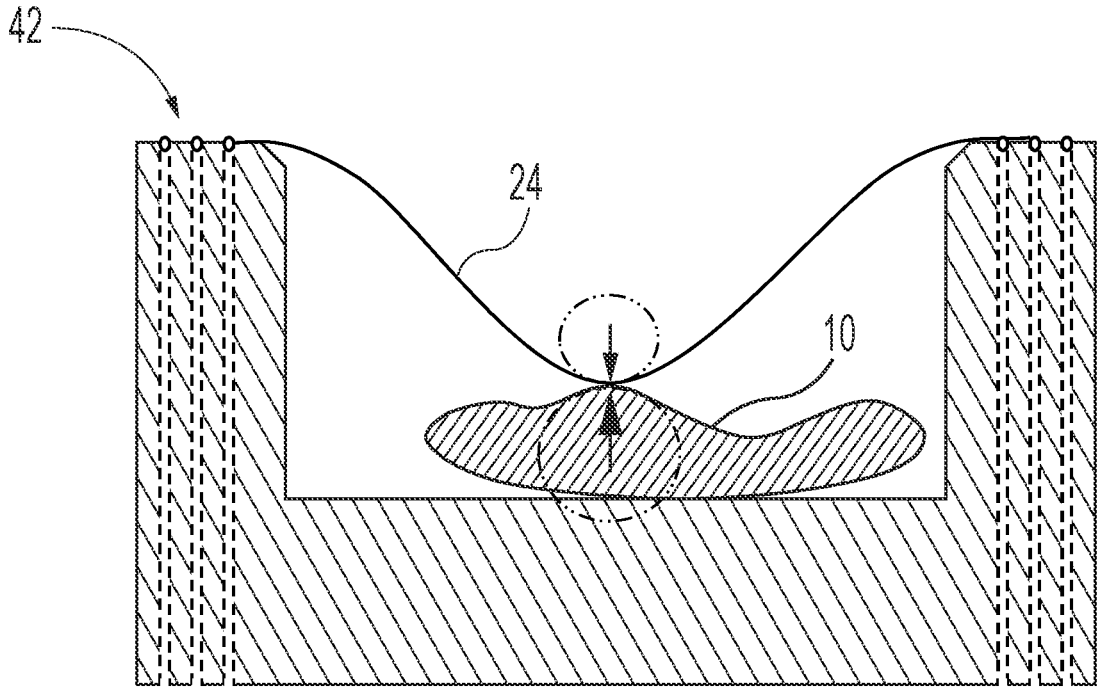
FIG. 11A is a side, partially cut-away view of a cavity including an article and a transfer component.
Figure 11B:
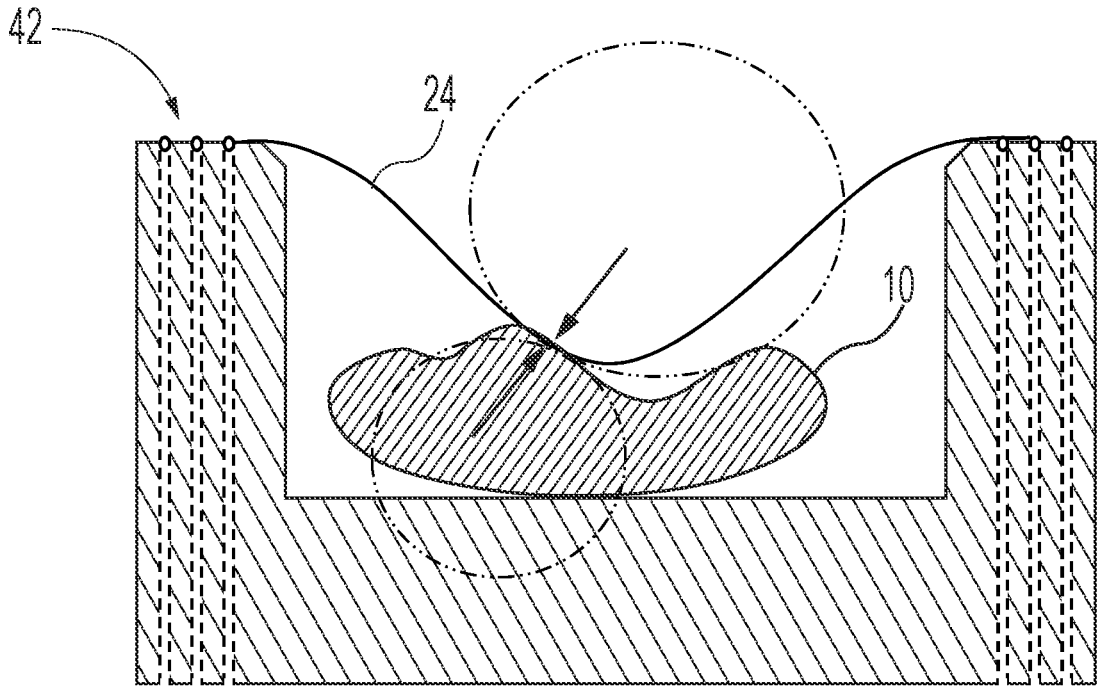
FIG. 11B is a side, partially cut-away view of a cavity including an article and a transfer component.

As illustrated in FIGS. 11A and 11B, articles of various sizes and geometries may be decorated using the process described herein. By controlling the unsupported portion of the transfer component and the initial contact area between the unsupported portion and the article, articles may be decorated with the transfer material and fluid trapped between this transfer material and the article is minimized or eliminated.

To further customize the aforementioned process, one or more support members 140 may be disposed in or adjacent to the frame to impart greater control over the modification of the unsupported portion of the transfer component. The support member 140 may be any structure that is used to support and/or control the modification of the unsupported portion 136 of the transfer component 24. As illustrated in FIGS. 12A, 12B, 12C, and 12D, the one or more support member 140 may be disposed within the cavity 24. The support members 140 may be positioned such that the support member 140 engages a portion of the unsupported portion 136 of the transfer component 24. The support members 140 may engage and change the radius of curvature of the unsupported portion 136 of the transfer component or the transfer component first radius of curvature $R1_{TC}$ or the transfer component second radius of curvature $R2_{TC}$. By changing the radius of curvature of the unsupported portion 136 of the transfer component, a relatively greater number of different sized and shaped articles may be decorated by the process while minimizing or eliminating wrinkles and fluid between the article and the transfer component. Further, the support members 140 may allow for more relatively complex shaped articles to be decorated.

The support members may engage portions of the unsupported portion of the transfer component to control how the unsupported portion is swept over the face and/or surfaces of the article. This again allows for reducing or eliminating trapped fluid between the article and the transfer component. The support members may be any shape and size, including height and width, such that the unsupported portion of the transfer component is engaged to control the radius of curvature and/or how the unsupported portion conforms to the article. The support members may be fixed or moveable within the cavity. It is also to be appreciated that the support members may be placed internal to and/or external to the cavity. The support members may extend over a portion of the opening 87 of the cavity to engage the unsupported portion of the transfer component. Any number of support members may be placed within the cavity. The support members may be positioned such that there is a gap between the support member and the article, or the support members may be positioned such that one or more support members abut a portion of the article.

Figure 12A:
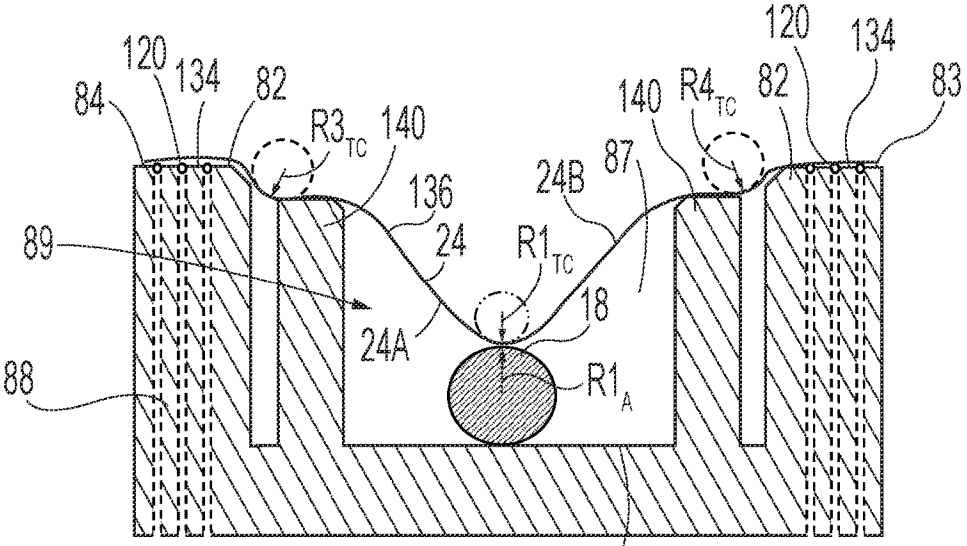
FIG. 12A is a side, partially cut-away view of a cavity including an article and a transfer component.
Figure 12B:
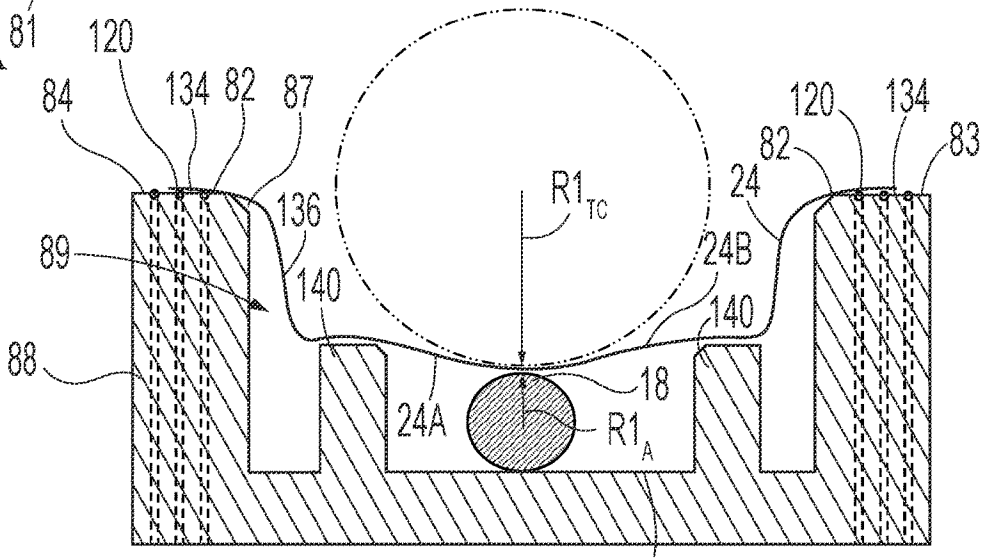
FIG. 12B is a side, partially cut-away view of a cavity including an article and a transfer component.

When the support member 140 engages the unsupported portion 136 of the transfer component 24, another, different radii of curvature are created in the unsupported portion 136 of the transfer component. For example, when the support member 140 engages the unsupported portion 136 of the transfer component, a transfer component third radius of curvature $R3_{TC}$ and a transfer component fourth radius of curvature $R4_{TC}$ may be formed, such as illustrated in FIG. 12A. It is to be appreciated that the support members may change the radii of curvature in the direction substantially parallel to the longitudinal axis and the direction substantially parallel to the transverse axis. Generally, the number of radii of curvature of the unsupported portion of the transfer material increase with the number of support members engaged.

Upon initial modification of the unsupported portion 136 of the transfer component 24 just prior to engagement of the unsupported portion 136 with a support member 140, the unsupported portion 136 may have a first, initial radius of curvature along a first surface in a first direction. Upon engagement of the unsupported portion 136 of the transfer component 24 with the support member 140, the first, initial radius of curvature may be changed and the unsupported portion 136 of the transfer component 24 may have two different radii of curvature along the same, first surface in the first direction of the unsupported portion of the transfer component 24.

It is to be appreciated that the unsupported portion 136 of the transfer component 24 may engage a support member prior to and/or after making initial contact with the article. For example, the unsupported portion of the transfer component may first engage a support member prior to engaging the article. The unsupported portion of the transfer component may first engage the article and then engage a support member. The unsupported portion of the transfer component may engage a first support member prior to engaging the article and a second support member after engaging the article. The number, placement, and geometry of the support member depend, in part, on the size of the cavity, the geometry of the article, and the characteristics of the transfer component, such as extensibility. It is to be appreciated that the support members may be supported by the back face frame, the front face, or any other portion of the frame of the cavity. For example, the support members may be cantilevered from the side of the frame of the cavity and extend over a portion of the opening of the cavity. The support members may be supported by the back face of the frame and extend from the back face of the frame toward the opening of the cavity.

Figure 12C:
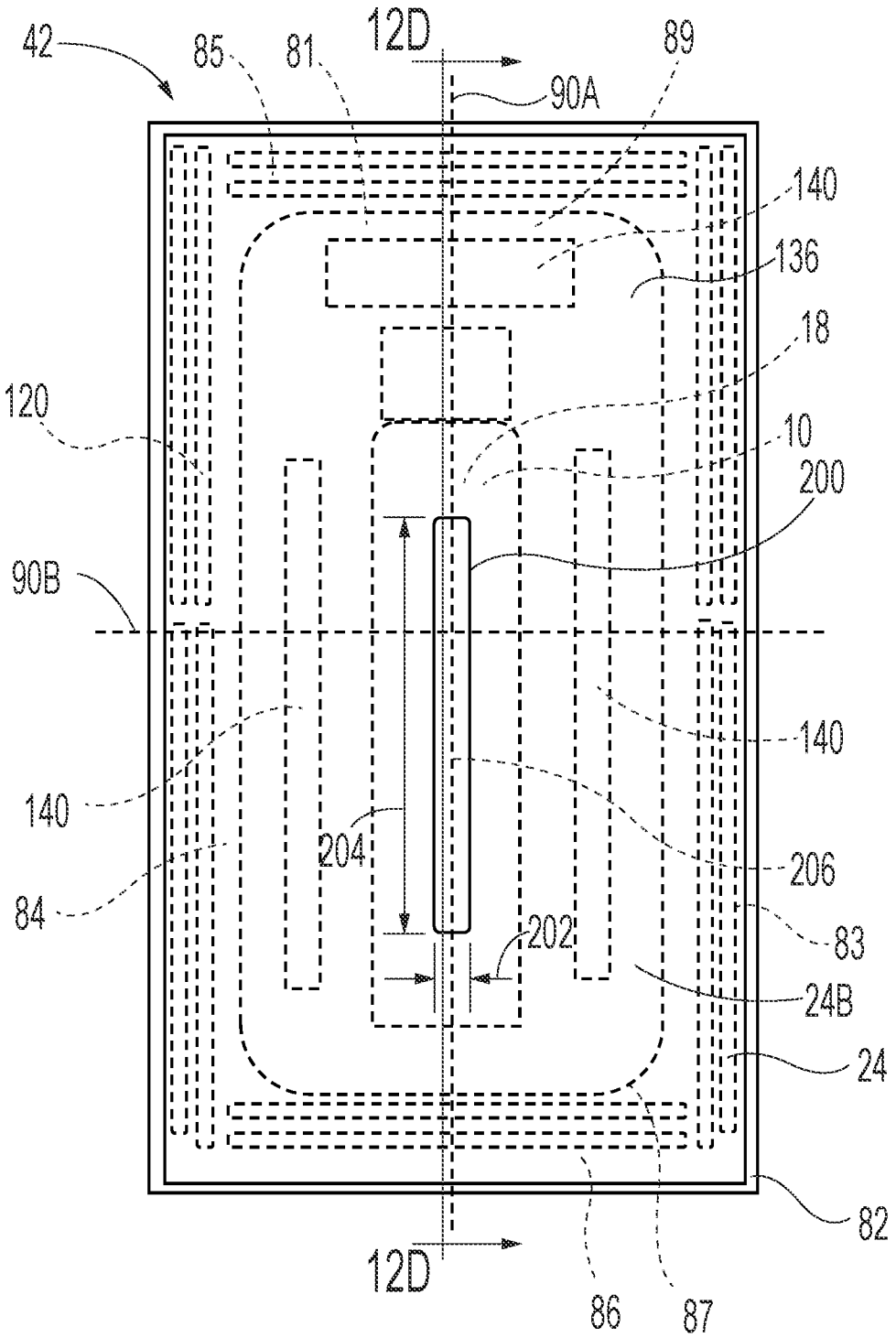
FIG. 12C is a top view of a cavity including an article and a transfer component.
Figure 12D:
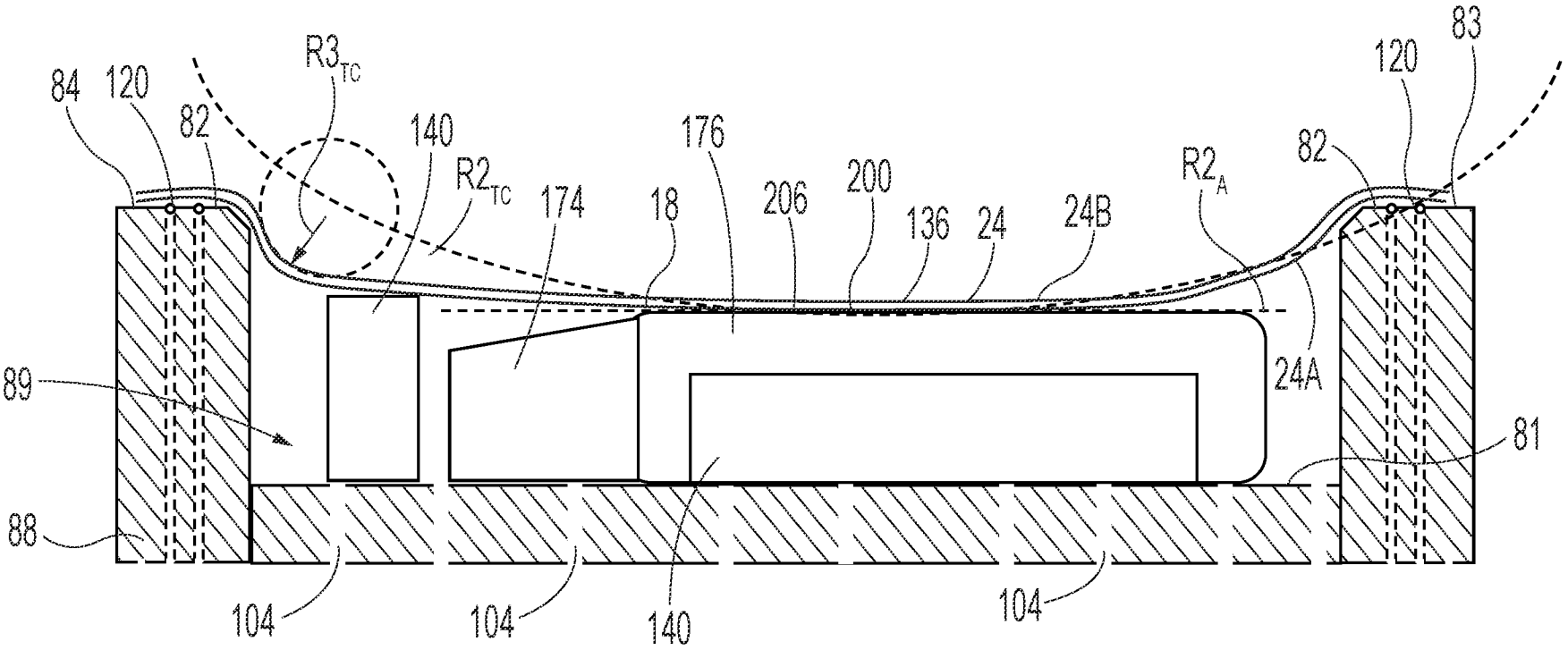
FIG. 12D is a cross-sectional view of the cavity including an article and a transfer component taken about line 12D-12D of FIG. 12C.

Referring to FIGS. 12C and 12D, a support member 140 may be positioned adjacent to a cap portion 174 of the article 10. The cap portion 174 may be removably attached to a body portion 176 of the article 10. The cap portion 174 may have a different geometry than the side body portion 176 of the article 10. To prevent fluid from being trapped between the article and the unsupported portion of the transfer component, the unsupported portion may first contact the body portion 176 of the article 10 and then contact the cap portion 174 of the article 10. Due to the different geometries of the cap portion 174 and the body portion 176, fluid would likely become trapped between the article and the unsupported portion of the transfer component if how the unsupported portion swept across the article was not controlled. To first contact the unsupported portion of the transfer component to the body portion 176 and subsequently contact the cap portion 174, a support member 140 may be positioned adjacent to the cap portion 174, as illustrated in FIG. 12. The support member 140 changes the radius of curvature of the unsupported portion of the transfer component such that the unsupported portion of the transfer component has a transfer component second radius of curvature $R2_{TC}$ and a transfer component third radius of curvature $R3_{TC}$.

Figure 13B:
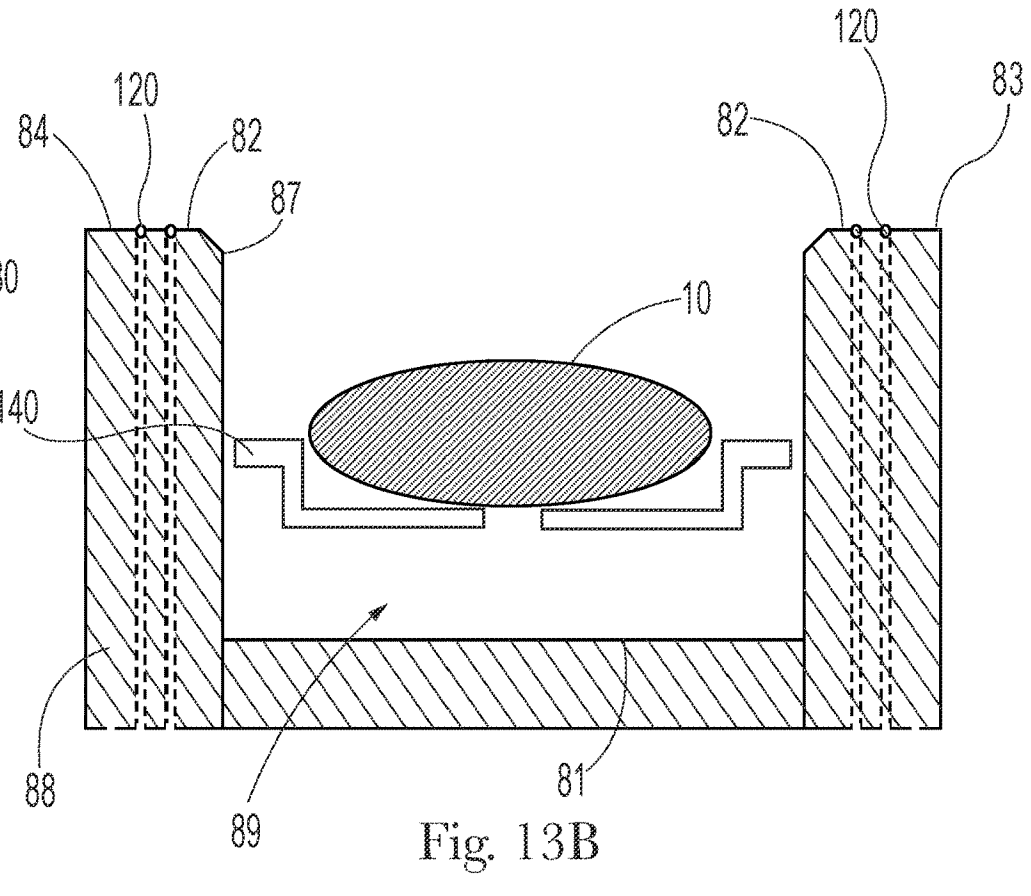
FIG. 13B is a cross-sectional view of the cavity including an article and a transfer component taken about line 13B-13B of FIG. 13A.
Figure 13A:
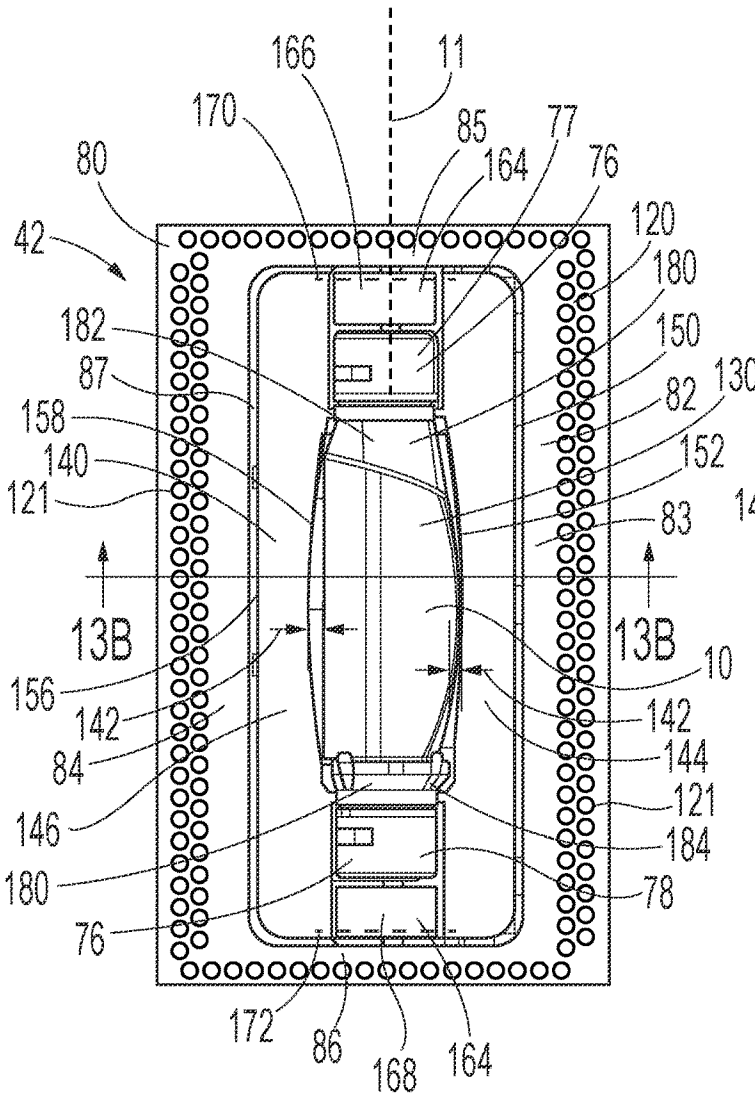
FIG. 13A is a top view of a cavity including an article and a transfer component.

The support member 140 may not only be configured to support the unsupported portion of the transfer material but also to support the article within the cavity 24. As illustrated in FIGS. 13A and 13B, the support member 140 may be disposed within the opening 87 of the cavity 42. The support member 140 may be positioned within the chamber 89 of the cavity 42. The support member 140 may extend from the upper portion 85 of the front face 82 to the lower portion 86 of the front face. The support member 140 may provide a support surface that extends from the opening 87 toward the article 10. The support member 140 may engage at least a portion of the article 10. For example, the support member 140 may engage the portion of the article 10 adjacent to the target face of the article 10. The support member 140 may also engage the portion of the article 10 positioned in facing relationship with the chamber 89 of the cavity 42. The support member 140 provides support to the transfer component 24 as a portion of the transfer component 24 is being conformed to the face of the article 10. The support member 140 may also aid in alignment and positioning of the article based on how the article fits with respect to the support member 140. Thus, the support member 140 may aid in reducing the variation and increasing the accuracy of the placement of the transfer material on the article. The transfer component 24 made be made from a material that fails if stretched beyond a certain point. The support member 140 allows the transfer component 24 to be conformed to the article face while preventing the transfer component 24 from, for example, breaking. The support member 140 may be stationary or moveable.

It is to be appreciated that the support member 140 may not need to engage the article 10 to provide support to the transfer component 24. A support gap 142 may be present between the article 10 and the support member 140. The maximum width of the support gap 142 may be determined, in part, due to the properties of the transfer component, such as flexibility and strength of the material, the shape of the article 10, and the forces exerted on the transfer component, such as a vacuum force or mechanical force to conform the transfer component to the article. For example, a relatively smaller support gap may be needed for a transfer component that is relatively thin, weak, and inflexible. A relatively larger support gap may be needed for a transfer component that is relatively think, strong, and flexible. It is also to be appreciated that portions of the support member 140 may abut the article while other portions of the support member 140 may form a support gap 142 between the article.

The first support member 140 may include a first support member portion 144 and a second support member portion 146. The first support member portion 144 and the second support member portion 146 may include a substantially planar surface that provides support of the transfer component from the front face 82 to the article 10 such as illustrated in FIGS. 13A and 13B. The first support member portion 144 and the second support member portion 146 may extend within the opening 87 of the cavity 42. The first support member portion 144 may extend along the first side portion 83 of the front face 82 and from the opening 87 toward the article 10. The second support member portion 146 may extend along the second side portion 84 of the front face 82 and from the opening 87 toward the article 10. The first support member portion 144 may include a first support edge 150 positioned adjacent to the opening 87 and a second support edge 152 positioned adjacent to the article 10. The first support edge 150 may have a first edge profile and the second support edge 150 may have a second edge profile. The first edge profile may be different than the second edge profile. The first edge profile may be shaped such that any gap between the opening 87 and the first support member portion does not adversely affect the transfer component. The second edge profile may be shaped such that any gap, referred to herein as the support gap 142, between the article 10 and the first support member portion also does not adversely affect the transfer component. The support gap 142 may be the shortest distance between a support edge and the article. The support gap 142 may be less than about 25 mm or less than about 20 mm or less than about 15 mm or less than about 12 mm or less than about 10 mm or less than about 8 mm or less than about 6 mm or less than about 4 mm or less than about 2 mm. It is to be appreciated that the support gap 142 distance may change for any given location on the article. The support gap 142 may be based on the geometry of the article and the geometry of the support member that substantially surrounds the article.

The second support member portion 146 may include a first support edge 156 positioned adjacent to the opening 87 and a second support edge 158 positioned adjacent to the article 10. The first support edge 156 may have a first edge profile and the second support edge 158 may have a second edge profile. The first edge profile may be different than the second edge profile. The first edge profile may be shaped such that any gap between the opening 87 and the second support member portion does not adversely affect the transfer component. The second edge profile may be shaped such that the support gap 142, the gap between the article 10 and the second support member portion, also does not adversely affect the transfer component. The edge profile of the second support edge 152 of the first support member portion 144 and the edge profile of the second support edge 158 of the second support member portion 146 may be the same or different. Further, the edge profile of the second support edge 152 of the first support member portion 144 and the edge profile of the second support edge 158 of the second support member portion 146 may be substantially the same as a portion of the external profile of the article or different. The second support edge 152 of the first support member portion 144 and the second support edge 158 of the second support member portion 146 may substantially surround a portion of the article 10 minimizing the support gap(s) between the article and the support member. It is to be appreciated that the first support member 140 may engage the article 10 such that no gap is present between the first support member 140 and the article 10.

The support member 140 may include a first support member portion 144 having a third support edge 154 and a second support member portion 146 having a third support edge 160. The third support edge 154 of the first support member portion 144 and the third support edge 160 of the second support member portion 146 may be positioned in facing relationship with the one or more faces of the article other than the target face, or stated another way, the one or more faces in facing relationship with the chamber 89 of the cavity 42. The first support member portion 144 may include a first support surface 151 extending between the first support edge 150 and the second support edge 152 that is configured to support a portion of the transfer component during transfer of the transfer material to the article. The first support member portion 144 may include a second support surface 155 extending between the second support edge 152 and the third support edge 160 that is configured to support the article or a portion thereof during the transfer of the transfer material. The second support member portion 146 may include a first support surface 161 extending between the first support edge 156 and the second support edge 158 that is configured to support a portion of the transfer component during transfer of the transfer material to the article. The second support member portion 146 may include a second support surface 162 extending between the second support edge 158 and the third support edge 160 that is configured to support the article or a portion thereof during the transfer of the transfer material. A support member 140 including multiple support surfaces may have a non-planar surface.

The cavity 42 may include a second support member 164. The second support member 162 may be positioned adjacent to the first support member 140 and may provide support within the opening 87 of the cavity 42 in any portion of the opening 87 in which a gap exists that may adversely affect the transfer component. The second support member 164 may be configured to rotate and/or traverse from a first configuration to a second configuration. In the first configuration the second support member 164 may rotate and/or traverse such that the article may be loaded and/or unloaded into the cavity. In the second configuration, the second support member 164 may rotate and/or traverse such that the article is positioned and held within the cavity and the transfer component may conform to the article having support in the areas surrounding the article such that the transfer component is not adversely affect.

As illustrated in FIG. 13A, the second support member 164 may include an upper support member portion 166 and a lower support member portion 168. The upper support member portion 166 may be positioned adjacent to a portion of the first support member portion 144 and a portion of the second support member portion 146. The lower support member portion 168 may be positioned adjacent to a portion of the first support member portion 144 and a portion of the second support member portion 146. The upper support member portion 166 may be configured to rotate about a first support member axis 170 to move from a first configuration to a second configuration. More specifically, in the first configuration, the upper support member portion 166 may rotate about the first support member axis 170. In the second configuration, the upper support portion 166 may be configured to rotate about the first support axis 170 such that the upper support member portion 166 provides a surface on which to support the transfer component during transfer of the transfer material to the article. Similarly, the lower support member portion 168 may be configured to rotate about a second support member axis 172 to move from a first configuration to a second configuration. More specifically, in the first configuration, the lower support member portion 168 may rotate about the second support member axis 172. In the second configuration, the lower support member portion 168 may be configured to rotate about the second support axis 172 such that the lower support member portion 168 is positioned to provide a surface on which to support the transfer component during transfer of the transfer material to the article.

It is to be appreciated that any number of support members may be positioned about the article 10. The number of support members positioned about the opening of the cavity may be determined, at least in part, based on the movement of the components within the cavity, the cost of manufacturing the cavity, the properties of the transfer component, and the characteristics of the article. It is also to be appreciated that a clamp, as discussed herein, may be integral with or separate from one or more support members. Further, the support members may be any shape that allows for controlling and supporting the unsupported portion of the transfer component.

To further control the article 10, the cavity 42 may include a clamp 76, such as illustrated in FIG. 13A. The clamp 76 may be disposed within each cavity 42. The clamp 76 may be used to receive, release, and hold the article 10. The clamp 76 may operatively engage any portion of the article 10 to receive and hold the article 10. The clamp may directly or indirectly engage any portion of the article 10 to receive/release and hold the article. The clamp 76 may be stationary or configured to move with respect to the cavity. The clamp 76 may hold the article 10 in a stationary position relative to the cavity. For a clamp 76 that is moveable, the clamp 76 may be powered by a power source that is internal to the cavity or external to the cavity. For example, to power the clamp to open to accept or release the article and/or to close to hold the article, the clamp may include an externally accessible cam follower that is configured to engage an external cam slot positioned adjacent to the cavity. Engagement of the cam follower with the slot may cause the clamp 76 to open or close and hold the article.

Further, the clamp 76 may be used to position the article 10. The clamp 76 may cause at least one of linear movement or rotational movement of the article. More specifically, the clamp 76 may be used to align the article about an axis of the article that positions the article in a desired orientation within the cavity. It is to be appreciated that the article 10 may or may not be symmetrical. The clamp 76 may also be used to rotate the article 10. The clamp 76 may be powered by a power source that is internal to the cavity or external to the cavity. For example, to power the clamp to rotate the article, the clamp may include an externally accessible cam slot that is configured to engage an external actuating finger positioned adjacent to the cavity. Engagement of the external finger with the slot may cause rotation of the article. It is to be appreciated that the article 10 may be rotated in any manner to change the face of the article that is in facing relationship with the transfer component. For example, the article may be rotated end-over-end. The article may be rotated about any axis. The axis of rotation may be the axis that most efficiently positions the face of the article to be decorated in facing relationship with the transfer component. The clamp 76 may be used to rotate the article 10 from 0 degrees to 360 degrees. Any face of the article 10 that is visible through the opening and in facing relationship with the transfer component is the face of the article to which the transfer material is to be transferred may be referred to herein as the target face of the article. The target face may include one or more surfaces of the article 10 to which the transfer material 22 is to be applied.

The clamp 76 may be configured to move in a direction substantially parallel to the front face 82 of the cavity 42. The movement of the clamp 76 may provide a gap into which the article 10 may be received. Further, the movement of the clamp 76 may again provide a gap that allows the article 10 to be removed from the cavity 42. The clamp 76 may be configured to traverse from a first clamp configuration, which provides a gap, and a second clamp configuration, which provides operative engagement between the clamp 76 and a portion of the article 10. The clamp 76 may be configured to operatively engage any portion of the article 10 such that the article 10 is held in position and the transfer material may be transferred to the article 10.

The clamp 76 may include a first clamp portion 77 and a second clamp portion 78. The first clamp portion 77 may operatively engage a first portion of the article 10 and the second clamp portion 78 may operatively engage a second portion of the article 10. For example, as illustrated in FIG. 13A, the first clamp portion 77 may engage a first end portion of the article, such as the neck of an article, and the second clamp portion may engage a second end portion of the article, such as the base of an article. At least one of the first clamp portion 77 and the second clamp portion 78 may be configured to move. The first clamp portion 77 and/or the second clamp portion 78 may be configured to move in a direction substantially parallel to the front face 82 of the cavity 42. The movement of at least one of the first clamp portion 77 and the second clamp portion 78 may provide a gap into which the article 10 may be received. Further, the movement may again provide a gap that allows the article 10 to be removed from the cavity 42. At least one of the first clamp portion 77 and the second clamp portion 78 may be configured to traverse from a first clamp configuration, which provides a gap for loading and unloading, and a second clamp configuration, which provides operative engagement between the clamp portions 77, 78 and a portion of the article 10. The first clamp portion 77 and the second clamp portion 78 may be configured to operatively engage any portion of the article 10 such that the article 10 is held in position and the transfer material may be transferred to the article 10.

It is to be appreciated that any number of clamps may be used to receive, hold, position, and release the article from the transfer device 48. The one or more clamps may engage any portion of the article such that the article is received, held, positioned, and removed from the transfer device 48.

The clamp 76 may be mechanical clamp or the clamp may be pneumatically controlled, electrostatically controlled, or some other similar mechanism that allows the article to be accepted by, held in position by, and released from the cavity.

Figure 13C:
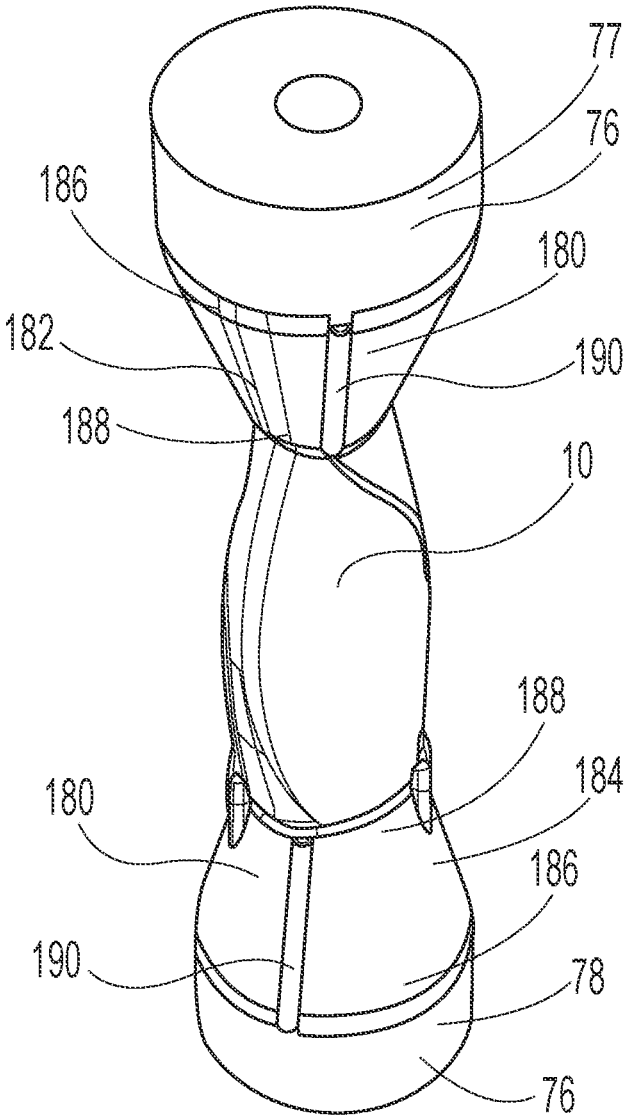
FIG. 13C is a perspective view of an article operatively engaged by a transition member.

The cavity 42 may include a transition member 180 operatively engaged with the clamp 76, as illustrated in FIGS. 13A and 13C. The transition member 180 may provide a transition surface between the clamp 76 and the article 10. The transition surface has a substantially tapered surface such that it provides a gradual transition from the exterior profile of the article to the exterior profile of the clamp. It is to be appreciated that an article 10 may include an exterior having an abrupt surface change, such as a right angle or a neck and opening for filing and dispensing product. During transfer of the transfer material, the transfer component conforms to the target surface of the article. An abrupt surface change in the exterior of the article may result in fluid becoming trapped between the target surface or the exterior of the article and the transfer component that is conformed thereto. Further, an abrupt surface change in the exterior of the article may result in breaking, stretching (such as beyond the plastic deformation point of the material), and/or puckering of the transfer component.

The transition member 180 may define a fluid tunnel 190 extending from a first end portion 186 to a second end portion 188 of the transition member, such as illustrated in FIG. 13C. The fluid tunnel 190 may be used to control the flow of fluid, such as air, as the transfer component conforms to the face of the article 10. As the transfer component is brought into contact with the article, such as in a sweeping motion, fluid between the transfer component and the article is directed toward the fluid tunnel 190. Fluid may pass through the fluid tunnel. The fluid tunnel 190 provides a path to allow fluid to escape from between the article and the transfer component and, thus, prevent fluid from becoming trapped between the article and the transfer component. It is undesirable for fluid to become trapped between the article and the transfer component. For example, trapped fluid may result in relatively poor adhesion of the transfer material to the article and trapped fluid may be aesthetically unappealing to consumers. Any number of fluid tunnels may be defined by the transition member. It is also to be appreciated that the length and placement of the fluid tunnels may vary and depend, in part, upon the characteristics of the transfer component and the article.

A fluid tunnel 190 is described herein as releasing fluid from between the article and the transfer component. However, it is to be appreciated that it need not be a tunnel but rather, any three-dimensional shape that allows fluid to escape from between the article and the transfer component.

The transition member 180 may include a first transition member portion 182 and a second transition member portion 184, such as illustrated in FIGS. 13A and 13C. The first transition member portion 182 may include a first end portion 186 and a second end portion 188 opposite the first end portion. The first end portion 186 of the first transition member portion 182 may be operatively engaged with the first clamp portion 77. The portion of the first clamp portion 77 engaged with the first end portion 186 of the first transition member portion 182 may have substantially the same cross-sectional shape or similar cross-sectional shapes such that transition from the clamp to the transition member does not adversely affect the transfer component. Similarly, the second end portion 188 of the first transition member portion 182 may operatively engage the article 10. The edge profile and the cross-sectional shape of the second end portion 188 of the first transition member portion 182 may be substantially the same as the article, such that the first transition member portion 182 fits with the article to provide transition from the article to the clamp that does not adversely affect the transfer component. The first transition member portion 182 may provide a transition surface from the article to the clamp such that the transition component is not adversely affected while being conformed to the target surface of the article and during transfer of the transfer material.

The second transition member portion 184 may include a first end portion 186 and a second end portion 188 opposite the first end portion. The first end portion 186 of the second transition member portion 184 may be operatively engaged with the second clamp portion 78. The portion of the second clamp portion 78 engaged with the first end portion 186 of the second transition member portion 184 may have substantially the same cross-sectional shape or similar cross-sectional shapes such that transition from the clamp to the transition member does not adversely affect the transfer component. Similarly, the second end portion 188 of the second transition member portion 184 may operatively engage the article 10. The edge profile and the cross-sectional shape of the second end portion 188 of the second transition member portion 184 may be substantially the same as the article, such that the second transition member portion 184 fits with the article to provide transition from the article to the clamp that does not adversely affect the transfer component. The second transition member portion 184 may provide a transition surface from the article to the clamp such that the transition component is not adversely affected while being conformed to the target surface of the article and during transfer of the transfer material.

The transfer processes and apparatuses described herein may provide a number of advantages. It should be understood, however, that such advantages are not required to be present unless set forth in the appended claims. The processes and apparatuses may be capable of decorating portions of articles that are currently difficult to decorate by direct printing, or transfer processes. Specifically, the processes described herein are capable of transferring a transfer material from the transfer component to articles with complex three-dimensional shapes and/or which have surface features that differ in height (or depth) by more than a limited extent. The transfer processes described herein provide several advantages over conventional compressible pads that are used for transferring materials, including the advantage that the thickness of the transfer component 24 does not vary extensively when transferring the transfer material to an article, and thus reduces and variations in the printed image that may occur over time due to wear on a compressible pad. The transfer process described herein may also provide advantages over methods that use a conventional transfer pad to transfer the material in which air may be trapped between a depression in the surface of the article and the transfer pad. These and at least some of the other distinctions and advantages over various known methods and articles produced by such methods are described below.

The transfer methods and articles described herein provide advantages over heat transfer label processes and screen printing processes and the articles formed thereby in that heat transfer label processes and screen printing processes are not believed to be capable of forming a continuous image on multiple portions of the surface of a three-dimensional article as described herein. The transfer methods and articles described herein provide advantages over vacuum sublimation processes and hydrographic processes and the articles formed thereby. The inks applied to articles by vacuum sublimation processes penetrate into the surface of the articles, and the inks applied to articles by hydrographic (water transfer printing) processes are etched into the surface of the articles. This makes these articles less suitable or unsuitable for recycling (which requires removal of the inks) than the articles formed by the transfer methods described herein on which the inks are applied on top of the surface (and may follow any contours on the surface, such as small waviness which may be present on plastic surfaces), but do not penetrate into the surface, and thus may be substantially completely removed for recycling and/or during a recycling process.

The transfer methods and articles described herein provide additional advantages over hydrographic processes and the articles formed thereby. Such processes are relatively slow and involve: preparing the surface of the substrate; priming the surface; painting the surface; and, processing the substrate by preparing a printed water-soluble polyvinyl alcohol film which is believed to utilize solvent-based ink, placing the film in a water dipping tank, applying an activator solution to the film to soften the base coat on the substrate, dipping the substrate into the water on top of the film to transfer the printing from the film to the substrate, rinsing and drying the substrate, and applying a clear coating. The transfer methods described herein take place in a non-aqueous environment in which no part of the article is at least partially submerged in water which require that the article be rinsed and dried. The articles described herein may be free of a softenable base coat and an activator (e.g., residual activator).

The transfer methods and articles described herein are also distinguishable from pre-printed thermoforms. Pre-printed thermoforms are articles that are typically made of plastic. After the article is printed, the article with the printing thereon is thermoformed (placed in an oven and formed) into the desired configuration. As a result, the article and the printing thereon are typically stretched the same amount during the thermoforming process.

After the transfer material 22 is transferred to the article(s) 10, the article(s) may be transferred by the conveyor to another conveyor or apparatus for further processing. For example, if the article(s) 10 are bottles, the bottles may be transferred from the conveyor to a filler, and capper.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "90°" is intended to mean "about 90°".

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited in the Detailed Description are, in relevant part, incorporated herein by reference; the citation of any document is not to be construed as an admission that it is prior art with respect to the present disclosure. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A method for transferring a transfer material from a transfer component to an article, the method comprising:

providing a cavity comprising a frame that defines an opening and a chamber, wherein the frame has a longitudinal axis and a transverse axis, and wherein the longitudinal axis is parallel to the transverse axis;

providing an article comprising a face, wherein the face comprises a first edge portion and a second edge portion;

providing a transfer component, wherein the transfer component comprises a transfer material;

transferring the article into the cavity;

positioning the transfer component over the frame, wherein the face of the article is in facing relationship with the transfer material disposed on the transfer component;

sealing a supported portion of the transfer component to a perimeter of the frame, wherein an unsupported portion of the transfer component is disposed over the opening;

applying a first pressure differential to the unsupported portion of the transfer component, wherein the unsupported portion of the transfer component is moved toward the first article;

contacting a portion of the unsupported portion of the transfer component to a portion the face of the article to form an initial contact area; and applying a second pressure differential to the unsupported portion of the transfer component, wherein the unsupported portion of the transfer component continues to contact the face of the article in a direction beginning from the initial contact area toward the frame.

2. The method of claim 1, comprising traversing the article and the cavity in a machine direction.

3. The method of claim 1, comprising contacting a portion of the unsupported portion of the transfer component with a first support member.

4. The method of claim 3, wherein the first support member abuts a portion of the frame.

5. The method of claim 3, wherein the first support member is positioned within the frame and a support gap is formed between the first support member and a portion of the frame.

6. The method of claim 5, wherein the portion of the transfer component disposed over the support gap forms a second unsupported portion, wherein the second unsupported portion has a transfer component third radius of curvature, and wherein the transfer component third radius of curvature is different than at least one of the transfer component second radius of curvature and the transfer component first radius of curvature.

7. The method of claim 1, wherein the initial contact area has an initial contact area first dimension and an initial contact area second dimension.

8. The method of claim 7, wherein at least one of the initial contact area first dimension and the initial contact area second dimension is less than about 0.25 inches.

9. The method of claim 1, wherein there is an intermediate portion of the face which is substantially centered within the frame.

10. The method of claim 1, comprising modifying the unsupported portion of the transfer component to form a contact radius of curvature; and positioning the article such that the contact radius of curvature of the transfer component engages the intermediate portion of the face of the article.

11. The method of claim 1, comprising removing the transfer component from the face of the article, wherein the transfer component is free of the transfer material.

* * * * *